US011491789B2

(12) United States Patent
Kobayashi

(10) Patent No.: US 11,491,789 B2
(45) Date of Patent: Nov. 8, 2022

(54) LIQUID EJECTION HEAD AND RECORDING APPARATUS

(71) Applicant: KYOCERA Corporation, Kyoto (JP)

(72) Inventor: Naoki Kobayashi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/044,152

(22) PCT Filed: Mar. 25, 2019

(86) PCT No.: PCT/JP2019/012483
§ 371 (c)(1),
(2) Date: Sep. 30, 2020

(87) PCT Pub. No.: WO2019/188969
PCT Pub. Date: Oct. 3, 2019

(65) Prior Publication Data

US 2021/0053347 A1 Feb. 25, 2021

(30) Foreign Application Priority Data

Mar. 30, 2018 (JP) ..... JP2018-067428

(51) Int. Cl.
*B41J 2/155* (2006.01)
*B41J 2/14* (2006.01)

(52) U.S. Cl.
CPC *B41J 2/155* (2013.01); *B41J 2/14* (2013.01)

(58) Field of Classification Search
CPC .... B41J 2/155; B41J 2/14; B41J 2002/14491; B41J 2002/14306; B41J 2/14233; B41J 2202/12; B41J 2002/14459; B41J 2/2146
See application file for complete search history.

(56) References Cited

U.S. PATENT DOCUMENTS

2008/0158295 A1 7/2008 Suzuki et al.
2013/0002771 A1* 1/2013 Fang ..... B41J 2/1433 347/85
2016/0193828 A1 7/2016 Hirakawa

FOREIGN PATENT DOCUMENTS

JP 2007-030242 A 2/2007
JP 2015-058572 A 3/2015
JP 2017-136744 A 8/2017

OTHER PUBLICATIONS

IP.com search (Year: 2021).*

* cited by examiner

*Primary Examiner* — Lisa Solomon
(74) *Attorney, Agent, or Firm* — Volpe Koenig

(57) ABSTRACT

A head comprises multiple nozzles on an ejection surface. The number n of nozzle rows each comprising a plurality m of nozzles arranged in a direction intersecting a first direction are disposed parallel to each other, where n and m are integers 2 or greater. Between the nozzles of each nozzle row, the nozzles of other of the nozzle rows are located as viewed in the first direction and the plurality of nozzles are located at the number m×n of dot positions. An interval defined by the number of dot positions from a dot position where one nozzle is arranged to a dot position just before a dot position where a next one of the nozzles is arranged in each row is referred to as nozzle pitch. At least one of the rows comprises two or more types of the nozzle pitches varying in the number of the dot positions.

20 Claims, 15 Drawing Sheets

FIG. 12A (n=9, k=3, NP: 6-3-18 or 12-3-12 or 9-3-15)

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 |
|---|---|---|---|---|---|---|---|---|---|---|---|---|---|---|---|---|---|---|---|---|---|---|---|---|---|---|---|
| 1 | ● | | | | | | ● | | | ● | | | | | | | | | | | | | | | | | |
| 2 | | | ● | | | | | | ● | | | ● | | | | | | | | | | | | | | | |
| 3 | | ● | | | | | | ● | | | ● | | | | | | | | | | | | | | | | |
| 4 | | | | ● | | | | | | | | | | | | ● | | | ● | | | | | | | | |
| 5 | | | | | | ● | | | | | | | | | | | | ● | | | ● | | | | | | |
| 6 | | | | | ● | | | | | | | | | | | | ● | | | ● | | | | | | | |
| 7 | | | | | | | | | | | | | ● | | | | | | | | | ● | | | ● | | |
| 8 | | | | | | | | | | | | | | | ● | | | | | | | | | ● | | | ● |
| 9 | | | | | | | | | | | | | | ● | | | | | | | | | ● | | | ● | |

FIG. 12B (n=8, k=2, NP: 5-11 or 3-13)

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | ● | | | | | ● | | | | | | | | | | |
| 2 | | ● | | | | | ● | | | | | | | | | |
| 3 | | | ● | | | | | ● | | | | | | | | |
| 4 | | | | ● | | | | | ● | | | | | | | |
| 5 | | | | | ● | | | | | ● | | | | | | |
| 6 | | | | | | | | | | | ● | | | ● | | |
| 7 | | | | | | | | | | | | ● | | | ● | |
| 8 | | | | | | | | | | | | | ● | | | ● |

LIQUID EJECTION HEAD AND RECORDING APPARATUS

TECHNICAL FIELD

The present disclosure relates to a liquid ejection head and a recording apparatus.

BACKGROUND ART

A known liquid ejection head performs printing by ejecting liquid (for example, ink) from multiple nozzles to a recording medium (for example, paper) (for example, PTL 1). Generally, the multiple nozzles are arranged in a direction intersecting a direction (hereinafter, referred to as first scanning direction) of relative movement between the liquid ejection head and the recording medium and form a nozzle row. A two-dimensional image is formed by repeating the ejection of liquid from the nozzle row while moving at least one of the recording medium and the liquid ejection head relative to each other. The liquid ejection head sometimes includes multiple nozzle rows. In this configuration, multiple nozzles forming nozzle rows are arranged such that the positions thereof in a direction (hereinafter, referred to as second scanning direction) orthogonal to the first scanning direction do not overlap one another. This can increase the density of dots on the recording medium in the second scanning direction.

CITATION LIST

Patent Literature

PTL 1: Japanese Unexamined Patent Application Publication No. 2007-30242

SUMMARY OF INVENTION

Technical Problem

A liquid ejection head according to one aspect of the present disclosure comprises a plurality of nozzles opened on an ejection surface extending in a first direction and a second direction orthogonal to the first direction, and the number n of nozzle rows each comprising m of the plurality of nozzles arranged in a direction intersecting the first direction are disposed parallel to each other, where n and m are each an integer of 2 or greater. Between the nozzles of each of the nozzle rows, the nozzles of other of the nozzle rows are located as viewed in the first direction and the plurality of nozzles are located at the number m×n of dot positions. At least one of the nozzle rows comprises two or more types of nozzle pitches varying in the number of dot positions, where each of the nozzle pitches is an interval defined by the number of dot positions from a dot position where one of the nozzles is arranged to a dot position just before a dot position where a next one of the nozzles is arranged in each of the nozzle rows is referred to as nozzle pitch.

A recording apparatus according to one aspect of the present disclosure comprises the aforementioned liquid ejection head and a moving unit that moves at least one of the liquid ejection head and a recording medium relative to each other in the first direction.

BRIEF DESCRIPTION OF DRAWINGS

FIG. 12A is a schematic diagram illustrating a nozzle arrangement according to an eleventh example and FIG. 12B is a schematic diagram illustrating a nozzle arrangement according to a twelfth example.

DESCRIPTION OF EMBODIMENTS

Figure 1A:
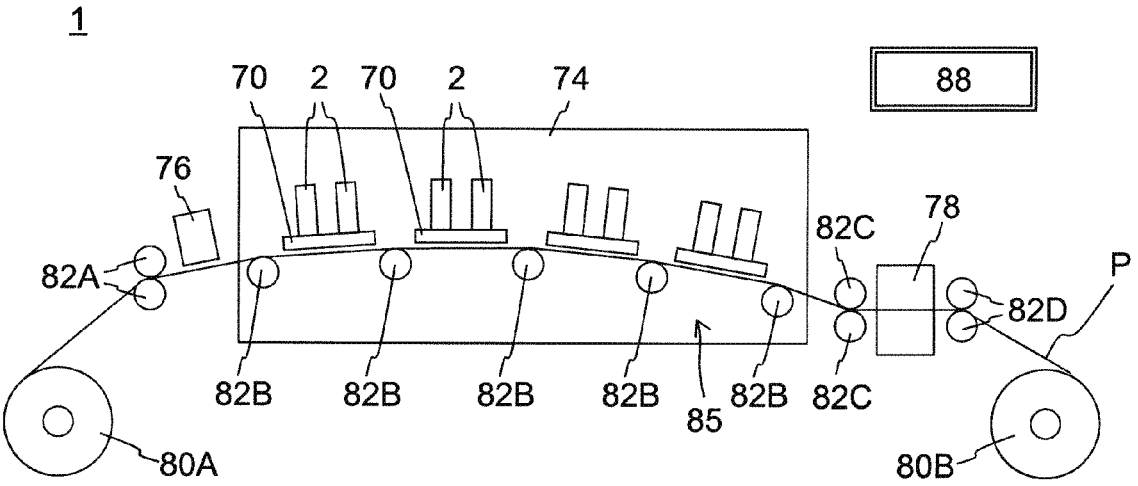
FIGS. 1A and 1B are a side view and a plan view schematically illustrating a recording apparatus including liquid ejection heads according to an embodiment.

Hereinafter, an embodiment of the disclosure is described with reference to the drawings. The drawings used in the following description are schematic, and the dimensional proportions and the like in the drawings are not always the same as actual ones. The dimensional proportions and the like of the same member illustrated in multiple drawings are not always the same to exaggerate the shape or the like.

[Overall Configuration of Printer]

Figure 1B:
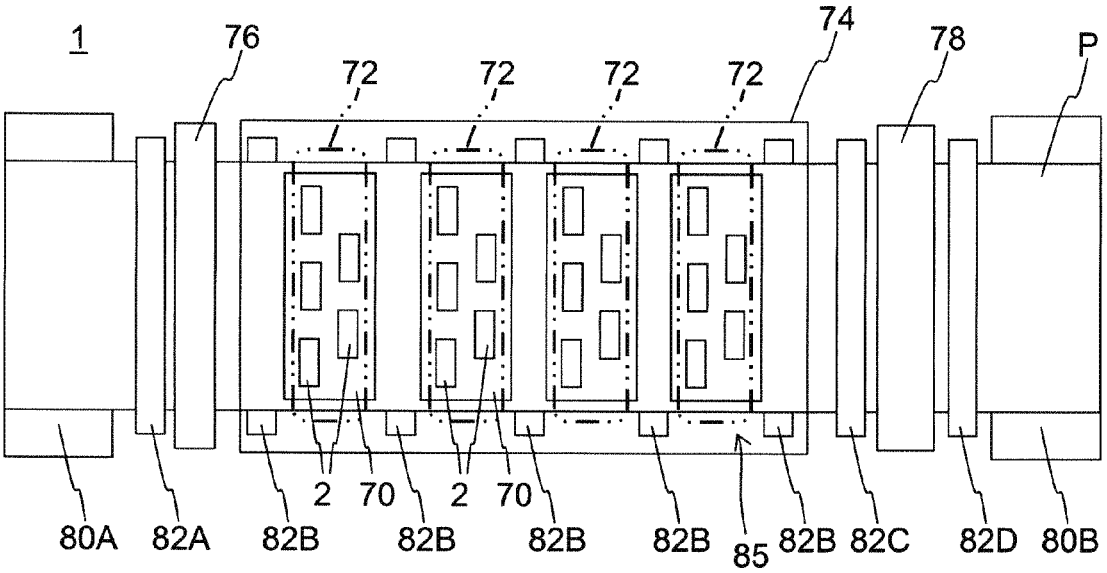

FIG. 1A is a side view illustrating an outline of a color inkjet printer (hereinafter, sometimes simply referred to as printer) that is a recording apparatus including liquid ejection heads 2 (hereinafter, sometimes simply referred to as heads) according to one embodiment of the disclosure and FIG. 1B is a plan view of the outline. The printer 1 conveys print paper P that is a recording medium from a conveyance roller 80A to a conveyance roller 80B and thereby moves the print paper P relative to the heads 2. The conveyance rollers 80A and 80B and various rollers to be described later form a moving unit 85 that moves at least one of the print paper P and the heads 2 relative to each other. A controller 88 controls the heads 2 on the basis of print data that is data on images, characters, and the like and performs recording such as printing on the print paper P by causing the heads 2 to eject liquid toward the print paper P and land droplets on the print paper P.

In the embodiment, the heads 2 are fixed to the printer 1 and the printer 1 is a so-called line printer. Another embodiment of the recording apparatus includes a so-called serial printer that alternately performs conveyance of the print paper P and an operation of moving the heads 2 by reciprocating the heads 2 or the like in a direction intersecting a conveyance direction of the print paper P, for example, in a direction substantially orthogonal to the conveyance direction, while ejecting droplets.

Four flat head-mounting frames 70 (hereinafter, sometimes simply referred to as frames) are fixed to the printer 1 and are substantially parallel to the print paper P. Each frame 70 includes not-illustrated five holes and five heads 2 are mounted on portions of the respective holes. The five heads 2 mounted on each frame 70 form one head group 72. The printer 1 includes four head groups 72 and a total of 20 heads 2 are mounted in the printer 1.

Liquid ejection portions of the heads 2 mounted on the frames 70 face the print paper P. The distance between each head 2 and the print paper P is about, for example, 0.5 to 20 mm.

The 20 heads 2 may be directly connected to the controller 88 or connected via a distribution unit that distributes the print data. For example, the configuration may be such that the controller 88 sends the print data to one distribution unit and the one distribution unit distributes the print data to 20 heads 2. Alternatively, for example, the configuration may be such that the controller 88 distributes the print data to four distribution units corresponding to the four head groups 72 and each distribution unit distributes the print data to five heads 2 in corresponding one of the head groups 72.

Each head 2 has a shape elongated in a direction away from the viewer in FIGS. 1A and 1*n* an up-down direction in FIG. 1B. In each head group 72, three heads 2 are arranged in a direction intersecting the conveyance direction of the print paper P, for example, in a direction substantially orthogonal to the conveyance direction and the other two heads 2 are arranged at positions shifted from the three heads 2 in the conveyance direction, between the three heads 2. In other words, the heads 2 are arranged in zigzag in each head group 72. The heads 2 are arranged such that ranges printable by the respective heads 2 are continuous with one another or ends of these ranges overlap one another in the width direction of the print paper P, that is, the direction intersecting the conveyance direction of the print paper P, and can perform printing with no gap in the width direction of the print paper P.

The four head groups 72 are arranged in the conveyance direction of the print paper P. Liquid, for example, an ink, is supplied from a not-illustrated liquid supply tank to each head 2. An ink of the same color is supplied to the heads 2 in each head group 72, and printing with inks of four colors can be performed with the four head groups 72. The colors of inks ejected from the respective head groups 72 are, for example, magenta (M), yellow (Y), cyan (C), and black (K).

The number of heads 2 mounted in the printer 1 may be one when printing is to be performed with one color for a range printable by one head 2. The number of heads 2 in each head group 72 or the number of head groups 72 can be changed as appropriate depending on a print target or print conditions.

In addition to printing with color inks, the heads 2 may perform printing to apply liquid such as a coating agent to the print paper P uniformly or in a certain pattern to perform surface treatment on the print paper P. For example, when a recording medium into which the liquid is less likely to soak is used, an agent that forms a liquid receiving layer may be used as the coating agent to facilitate fixing of the liquid. When a recording medium into which the liquid is likely to soak is used, an agent that forms a liquid infiltration suppressing layer may be used as the coating agent to suppress excessively large bleeding of the liquid and mixing of the liquid with another liquid landing next to the liquid. Instead of the heads 2, an application device 76 controlled by the controller 88 may uniformly apply the coating agent.

The printer 1 performs printing on the print paper P that is the recording medium. The print paper P is wound on the paper feeding roller 80A. The print paper P sent out from the paper feeding roller 80A passes below the heads 2 mounted on the frames 70, then passes between two conveyance rollers 82C, and is eventually rewound on the rewinding roller 80B. In the printing, the print paper P is conveyed at fixed speed by being rotated by the conveyance rollers 82C and the heads 2 perform printing on the print paper P.

Next, details of the printer 1 are described according to the order of conveyance of the print paper P. The print paper P sent out from the paper feeding roller 80A passes between two guide rollers 82A and then passes below the application device 76. The application device 76 applies the aforementioned coating agent to the print paper P.

The print paper P then enters a head chamber 74 housing the frames 70 on which the heads 2 are mounted. The head chamber communicates with the outside in some portions such as portions where the print paper P enters and exits the head chamber 74 but is substantially a space that is isolated from the outside. The controller 88 or the like controls control factors such as temperature, humidity, and air pressure in the head chamber 74 as necessary. Effects of external disturbances in the head chamber 74 can be reduced from those in the outside where the printer 1 is installed, and fluctuation ranges of the aforementioned control factors can be thus reduced from those in the outside.

Five guide rollers 82B are arranged in the head chamber 74 and the print paper P is conveyed on the guide rollers 82B. The five guide rollers 82B are arranged in a convex pattern whose center portion protrudes toward an area where the frames are arranged as viewed from the side. The print paper P conveyed on the five guide rollers 82B thereby has an arc shape as viewed from the side and applying tension to the print paper P causes a portion of the print paper P between each pair of adjacent guide rollers 82B to be tensioned to have a flat shape. One frame 70 is arranged between each pair of adjacent guide rollers 82B. Installation angles of the frames 70 slightly vary from one another such that the frames 70 are parallel to the print paper P conveyed therebelow.

The print paper P that exits the head chamber 74 passes between the two conveyance rollers 82C, passes through a dryer 78, passes between two guide rollers 82D, and is rewound on the rewinding roller 80B. The conveyance speed of the print paper P is, for example, 100 m per minute. The rollers may be controlled by the controller 88 or manually operated by a person.

Drying the print paper P with the dryer 78 makes it less likely that overlapping portions of the rewound recording medium P adhere to each other or undried liquid causes smudges on the rewinding roller 80B. Quick drying is also necessary for high-speed printing. For quick drying, the dryer 78 may dry the print paper P by performing drying in multiple drying methods sequentially or in parallel. The drying methods used in such a circumstance include, for example, blowing of hot air, infrared irradiation, contact with a heated roller, and the like. In the infrared irradiation, the print paper P may be irradiated with infrared rays of a specific frequency range to be dried quickly with less damage on the print paper P. When a heated roller is brought into contact with the print paper P, the time to transfer heat may be increased by conveying the print paper P along a cylindrical surface of the roller. A range in which the print paper P is conveyed along the cylindrical surface of the roller is preferably a quarter of the circumference of the cylindrical surface of the roller or more, more preferably a half of the circumference of the cylindrical surface of the roller or more. When printing is performed with a UV-curable ink or the like, a UV irradiation light source may be arranged instead of or in addition to the dryer 78. The UV irradiation light source may be arranged between each pair of adjacent frames 70.

The printer 1 may include a cleaning unit that cleans the heads 2. The cleaning unit performs, for example, wiping or cleaning with capping. For example, in the wiping, surfaces of portions that eject the liquid, for example, ejection surfaces 2*a* (to be described later) are rubbed with a flexible wiper and the liquid adhering to the surfaces are thereby removed. The cleaning with capping is performed, for example, as follows. First, each of the portions that eject the liquid, for example, the ejection surfaces 2*a* is covered with a cap (this action is referred to as capping) and a substantially sealed space is thereby formed by the ejection surface 2*a* and the cap. Ejection of the liquid is repeated in this state to remove foreign substances, the liquid clogging nozzles 3 (to be described later) and having higher viscosity than the liquid in the normal state, and the like. The capping can make it less likely for the liquid to scatter in the printer 1 during the cleaning and less likely for the liquid to adhere to the print paper P and conveyance mechanisms such as the rollers. The cleaned ejection surface 2*a* may be further subjected to wiping. A person may manually perform the wiping and the cleaning with capping by manually operating the wiper and the caps attached to the printer 1 or the controller 88 may automatically perform the wiping and the cleaning with capping.

The recording medium may be a roll of cloth or the like instead of the print paper P. Moreover, instead of directly conveying the print paper P, the printer 1 may directly covey a conveyor belt and convey the recording medium with the recording medium placed on the conveyor belt. In this configuration, sheets, pieces of cut cloth, pieces of wood, tiles, and the like can be used as the recording medium. Moreover, the printer 1 may print a wiring pattern of an electronic device or the like by ejecting liquid containing conductive particles from the heads 2. Furthermore, the printer 1 may produce a chemical by ejecting a predetermined amount of a liquid chemical agent or a predetermined amount of liquid containing a chemical agent from the head 2 to a reaction container or the like and causing the chemical agent to react.

The printer 1 may be configured such that a position sensor, a speed sensor, a temperature sensor, and the like are attached to the printer 1 and the controller 88 controls the units of the printer 1 depending on statuses of the units of the printer 1 known from information from the sensors. For example, when the temperature of each head 2, the temperature of liquid in a liquid supply tank configured to supply the liquid to the head 2, pressure applied to the head 2 by the liquid in the liquid supply tank, and the like affect ejection characteristics, that is an ejection amount, ejection speed, and the like of the liquid to be ejected, the controller 88 may change drive signals for ejecting the liquid depending on the information.

[Outline of Nozzle Arrangement]

Figure 2A:
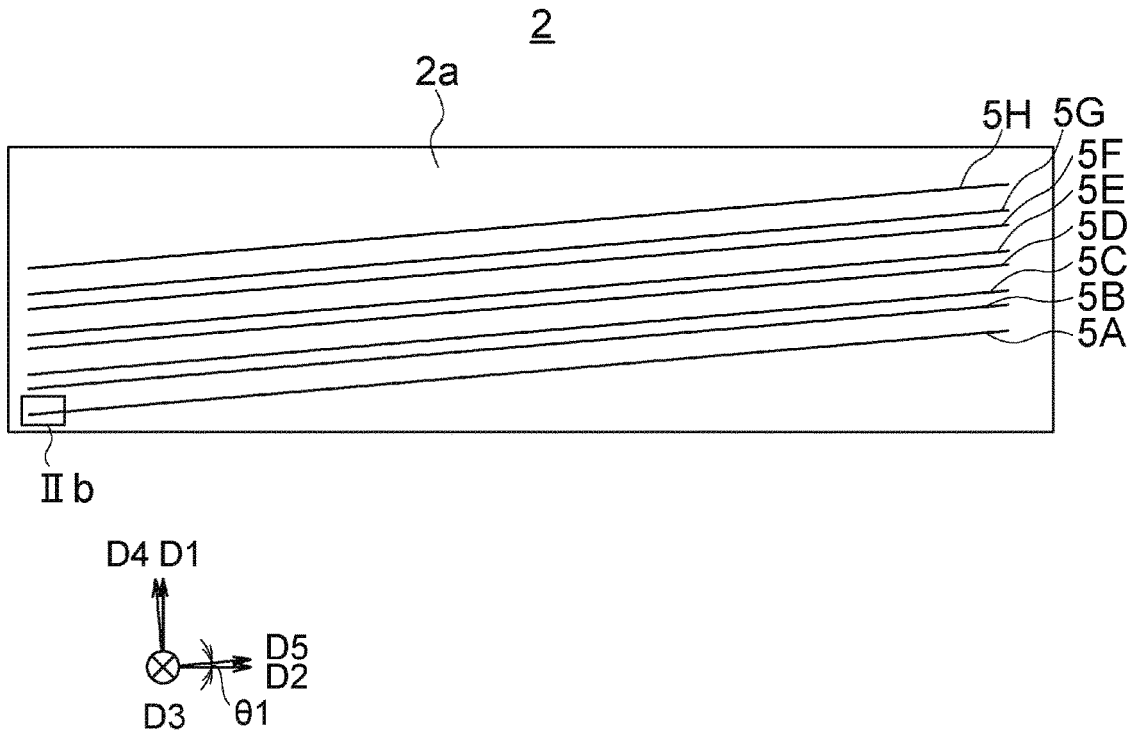
FIG. 2A is a plan view illustrating a lower surface of each liquid ejection head according to the embodiment and FIG. 2B is an enlarged view of the region IIb in FIG. 2A.
Figure 2B:
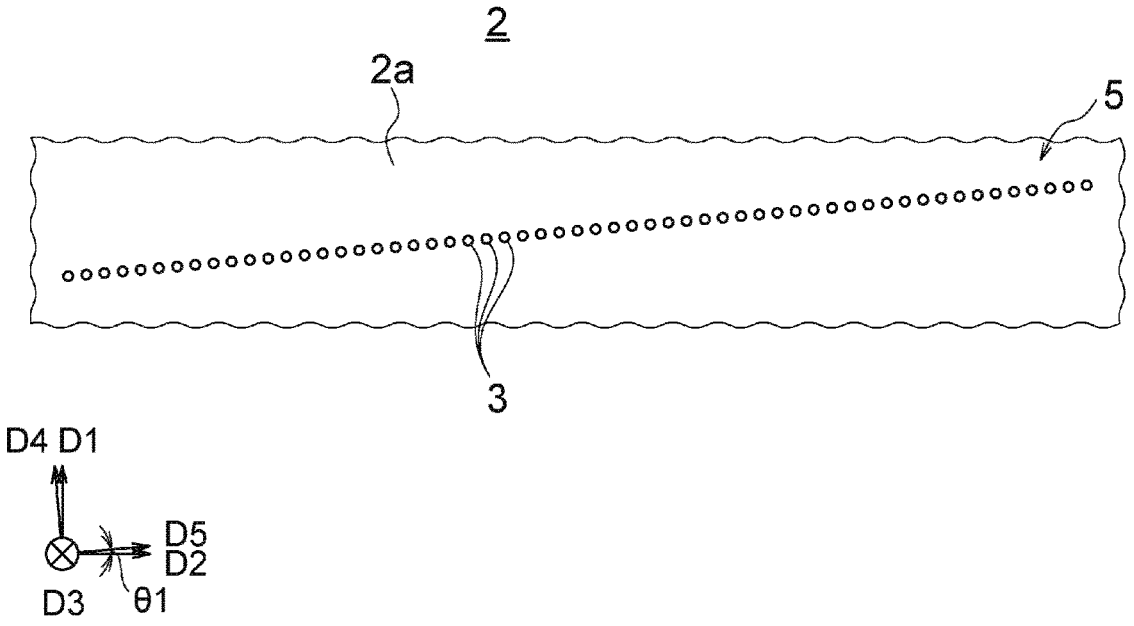

FIG. 2A is a plan view illustrating a surface (ejection surface 2*a*) of each head 2 that faces the recording medium P. FIG. 2B is an enlarged view of the region IIb in FIG. 2A. In these drawings, an orthogonal coordinate system including a D1 axis, a D2 axis, a D3 axis, and the like are illustrated for the sake of convenience. The D1 axis is defined to be parallel to the direction of movement of the recording medium P relative to the head 2. A relationship between positive and negative of the D1 axis and the traveling direction of the recording medium P relative to the head 2 does not matter in the description of the embodiment. The D2 axis is defined to be parallel to the ejection surface 2*a* and the recording medium P and orthogonal to the D1 axis. The positive and negative of the D2 axis also do not matter. The D3 axis is defined to be orthogonal to the ejection surface 2*a* and the recording medium P. A negative direction in D3 (direction from the sheet surfaces of FIGS. 2A and 2B toward the viewer) is assumed to be a direction from the head 2 toward the recording medium P. The head 2 may be used with any side thereof being the upper side or the lower side. However, terms such as lower surface are sometimes used assuming that the positive D3 side is the upper side for the sake of convenience.

The ejection surface 2*a* includes multiple nozzles 3 that eject ink droplets. The multiple nozzles 3 are arranged at positions different from each other in the D2 direction. Accordingly, any two-dimensional image may be formed by ejecting ink droplets from the multiple nozzles 3 while moving the recording medium P relative to the head 2 in the D1 direction with the moving unit 85.

To be more specific, the multiple nozzles 3 are arranged in multiple rows (eight rows in the illustrated example). Specifically, the multiple nozzles 3 form multiple nozzle rows 5A to 5H (A to H are sometimes omitted hereinafter). Each nozzle 3 corresponds to one dot on the recording medium P. In FIG. 2A, since the nozzles 3 are very small relative to the ejection surface 2*a*, the nozzle rows 5 are illustrated as straight lines. In the enlarged view of FIG. 2B, the nozzles 3 are illustrated larger than the actual nozzles (enlarged relative to the pitch).

The multiple nozzle rows 5 are, for example, substantially parallel to one another and have equal length. In the illustrated example, the nozzle rows 5 are tilted with respect to the D2 direction. In FIGS. 2A and 2B, a D5 axis substantially parallel to the nozzle rows 5 and a D4 axis orthogonal to the D5 axis are illustrated. A tilt angle θ1 of the nozzle rows 5 with respect to the D2 axis may be set as appropriate. Note that such tilt may not be disposed. Hereinafter, description is sometimes given assuming that the tilt angle θ1 is zero (D1 axis and D4 axis coincide with each other and D2 axis and D5 axis coincide with each other).

In the example of FIGS. 2A and 2B, the sizes of gaps between the multiple nozzle rows 5 are not equal and the size of every other gap is the same. Such a configuration is due to, for example, arrangement of channels in the head 2. However, the sizes of the multiple gaps may be equal. In the following description, whether the sizes of the gaps between the nozzle rows 5 are equal or not is ignored.

Each nozzle row 5 includes a relatively large number of nozzles 3. For example, the number of nozzles 3 in each nozzle row 5 is greater than at least the number of nozzle rows 5 (the number of rows). The number of nozzles 3 in each nozzle row 5 may be set as appropriate and is, for example, 700 or more and 1000 or less.

Relationship Between Nozzle Rows in Comparative Example

Figure 3:
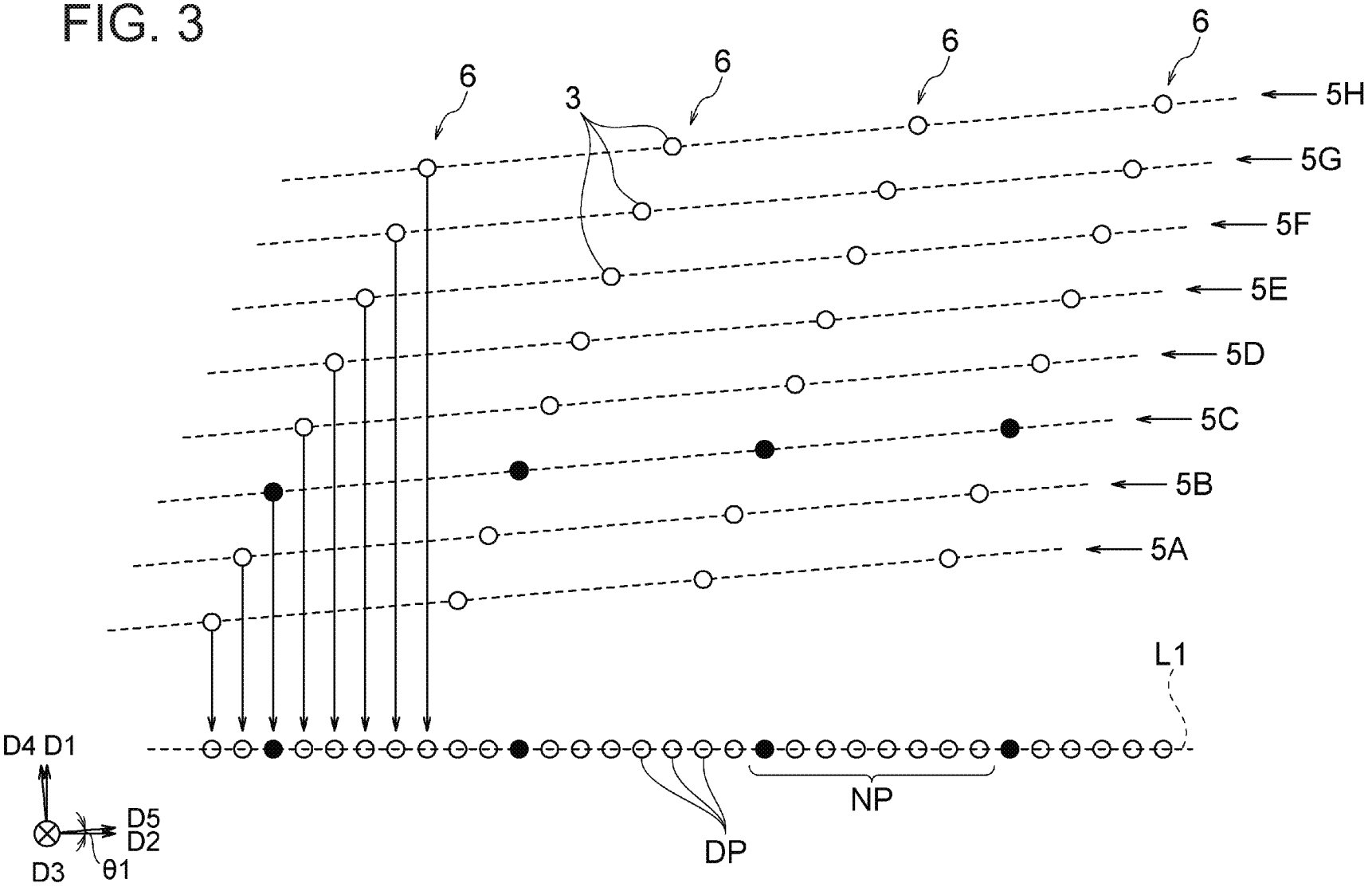
FIG. 3 is a schematic diagram for explaining an outline of a positional relationship of multiple nozzle rows by using a comparative example as an example.

FIG. 3 is a schematic diagram for explaining an outline of a positional relationship of the nozzles 3 in the multiple nozzle rows 5. In this section, a comparative example is described as an example to facilitate the understanding. In the comparative example, the pitch of the multiple nozzles 3 in each nozzle row 5 is constant in the D5 (D2) direction. Moreover, this pitch is the same among the multiple nozzle rows 5. The nozzles 3 in the nozzle row 5C are illustrated as black circles unlike the other nozzles 3 and this is only to facilitate the description.

The multiple nozzle rows 5 include the multiple nozzles 3 such that the nozzles 3 in the respective nozzle rows 5 are arranged one by one in order when the nozzles 3 are projected in the D1 direction (direction in which the recording medium P is moved relative to the head 2) on a line L1 parallel to the D2 direction as illustrated by the arrows. This order is determined in advance for the multiple nozzle rows 5. The pitch, in the D2 direction, of the multiple nozzles 3 projected on the line L1 is constant.

As understood from the above description, when the head 2 includes n nozzle rows 5, the dot density on the line L1 is n times the dot density in each nozzle row 5. The dot density may be set as appropriate. For example, when the dot density in each nozzle row 5 in the D2 direction is 100 dpi or more and 200 dpi or less, the dot density in the D2 direction achieved by eight nozzle rows 5 is 800 dpi or more and 1600 dpi or less.

In the illustrated example, the order in which the multiple nozzle rows 5 are arranged in the D1 direction is the same as the order in which the nozzles 3 of the respective nozzle rows 5 are arranged on the line L1 for the convenience of description. From another perspective, multiple nozzles 3 form nozzle columns 6 substantially linearly extending in a direction intersecting the D5 axis. The two types of arrangement orders described above may be different from each other. From another perspective, the nozzles 3 may not form the linear nozzle columns 6.

[Definition of Dot Position and Nozzle Pitch]

In the following description, the positions of the nozzles 3 projected on the line L1 are conceptually referred to as dot positions DP. When n nozzle rows 5 each including m nozzles 3 are viewed in the D1 direction, between the nozzles 3 of each nozzle row 5, the nozzles 3 of the other nozzle rows 5 are located and the nozzles 3 are thereby located at m×n dot positions DP.

Moreover, an interval defined by the number of the dot positions DP from the dot position DP where one nozzle 3 is arranged to the dot position DP just before the dot position DP where the next nozzle 3 is arranged in each nozzle row 5 is referred to as nozzle pitch NP. In FIG. 3, the nozzle pitch NP of the nozzle row 5C is denoted by a reference sign as an example. In the following description, NP is sometimes expressed as if NP is the number of the dot positions DP in the nozzle pitch NP.

In each nozzle row 5, the nozzle pitch NP from the nozzle located furthermost to the positive D2 side (terminal edge side) may be defined by the number of the dot positions DP from this nozzle 3 to the dot position DP just before the nozzle 3 located furthermost to the negative D2 side (starting edge side), assuming that the nozzle pitch NP returns from the terminal edge to the starting edge.

[Outline of Head Structure]

Figure 4:
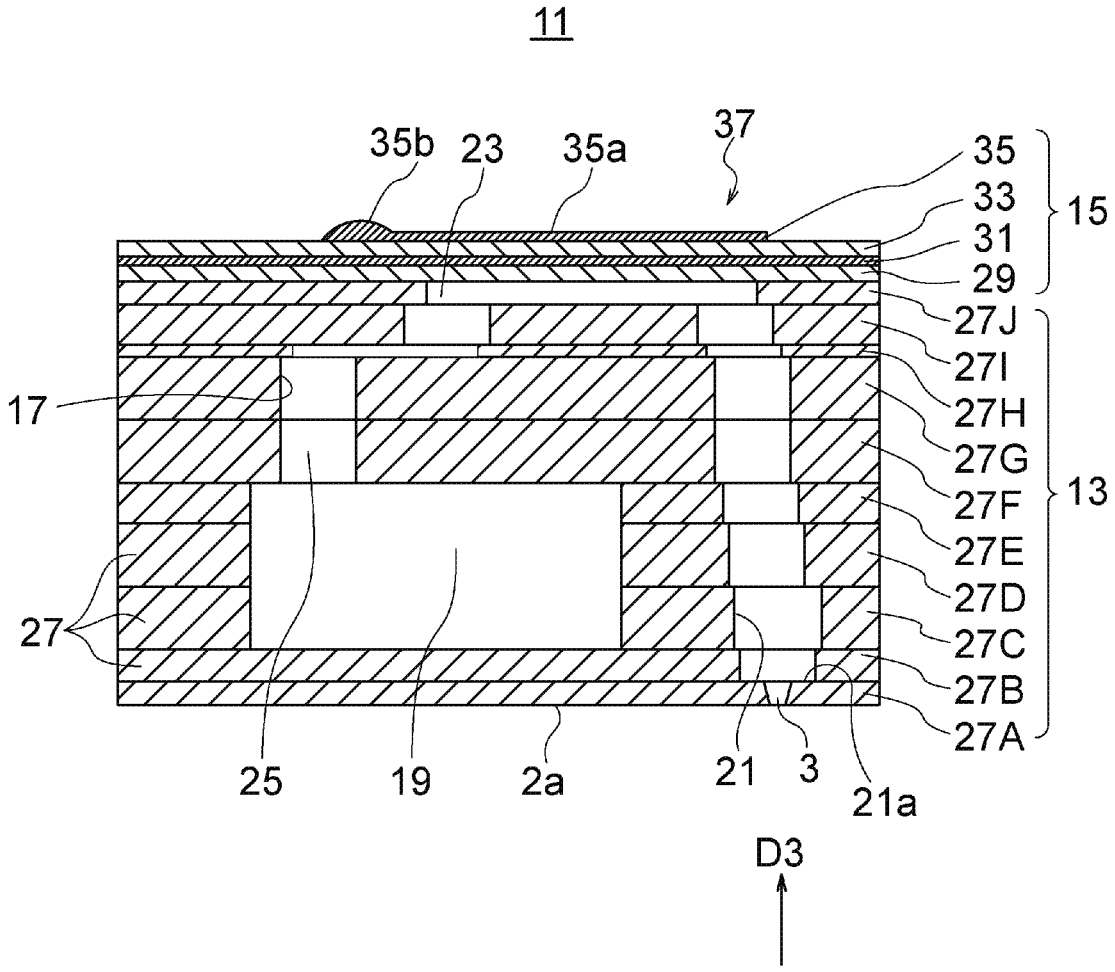
FIG. 4 is a schematic sectional view illustrating part of the liquid ejection head according to the embodiment in an enlarged manner.

FIG. 4 is a schematic sectional view illustrating part of the head 2 in an enlarged manner. The lower side of the sheet surface of FIG. 4 is the side facing the recording medium P (negative D3 side).

The head 2 is a piezoelectric head that applies pressure to ink by means of mechanical strain of a piezoelectric element. The head 2 includes multiple ejection elements 11 for the respective nozzles 3 and FIG. 4 illustrates one of the ejection elements 11.

Although not particularly illustrated, for example, the multiple ejection elements 11 form a row substantially for each nozzle row 5. The direction and the number of ejection elements 11 in each row may be set as appropriate together with matters such as a design of a route of a common channel 19 to be described later. For example, the directions of the respective ejection elements 11 in each row may be the same or alternately reversed. Moreover, one row of ejection elements 11 may be disposed for one nozzle row 5, or two rows of ejection elements 11 may be disposed for one nozzle rows 5 in opposite directions on both sides of the nozzle row 5. Two rows of ejection elements 11 that correspond to two nozzle rows 5 adjacent to each other may be formed such that the ejection elements 11 in one row and the ejection elements 11 in the other row are alternately arranged and apparently form one row.

From another viewpoint, the head 2 includes a channel member 13 that forms a space to store the ink and an actuator 15 that applies pressure to the ink stored in the channel member 13. The channel member 13 and the actuator 15 form the multiple ejection elements 11.

[Configuration of Channel Member]

Multiple individual channels 17 (one is illustrated in FIG. 4) and the common channel 19 communicating with the multiple individual channels 17 are formed in the channel member 13. The individual channels 17 are disposed for the respective ejection elements 11 while the common channel 19 is shared by the multiple ejection elements 11.

Each individual channel 17 includes the aforementioned nozzle 3, a partial channel 21 that includes a bottom surface 21*a* in which the nozzle 3 is opened, a pressure chamber 23 that communicates with the partial channel 21, and a communication channel 25 that allows the pressure chamber 23 and the common channel 19 to communicate with each other.

The multiple individual channels 17 and the common channel 19 are filled with the ink. When the capacity of the pressure chamber 23 changes and pressure is applied to the ink, the ink is sent out from the pressure chamber 23 to the partial channel 21 and an ink droplet is ejected from the nozzle 3. The pressure chamber 23 is refilled with the ink from the common channel 19 through the communication channel 25.

The sectional shapes or planar shapes of the multiple individual channels 17 and the common channel 19 may be set as appropriate. The configurations (excluding the directions in plan view) of the individual channels 17 are, for example, substantially the same. However, the individual channels 17 may vary in some of the configurations such as the tilt of the partial channel 21.

Figure 14:
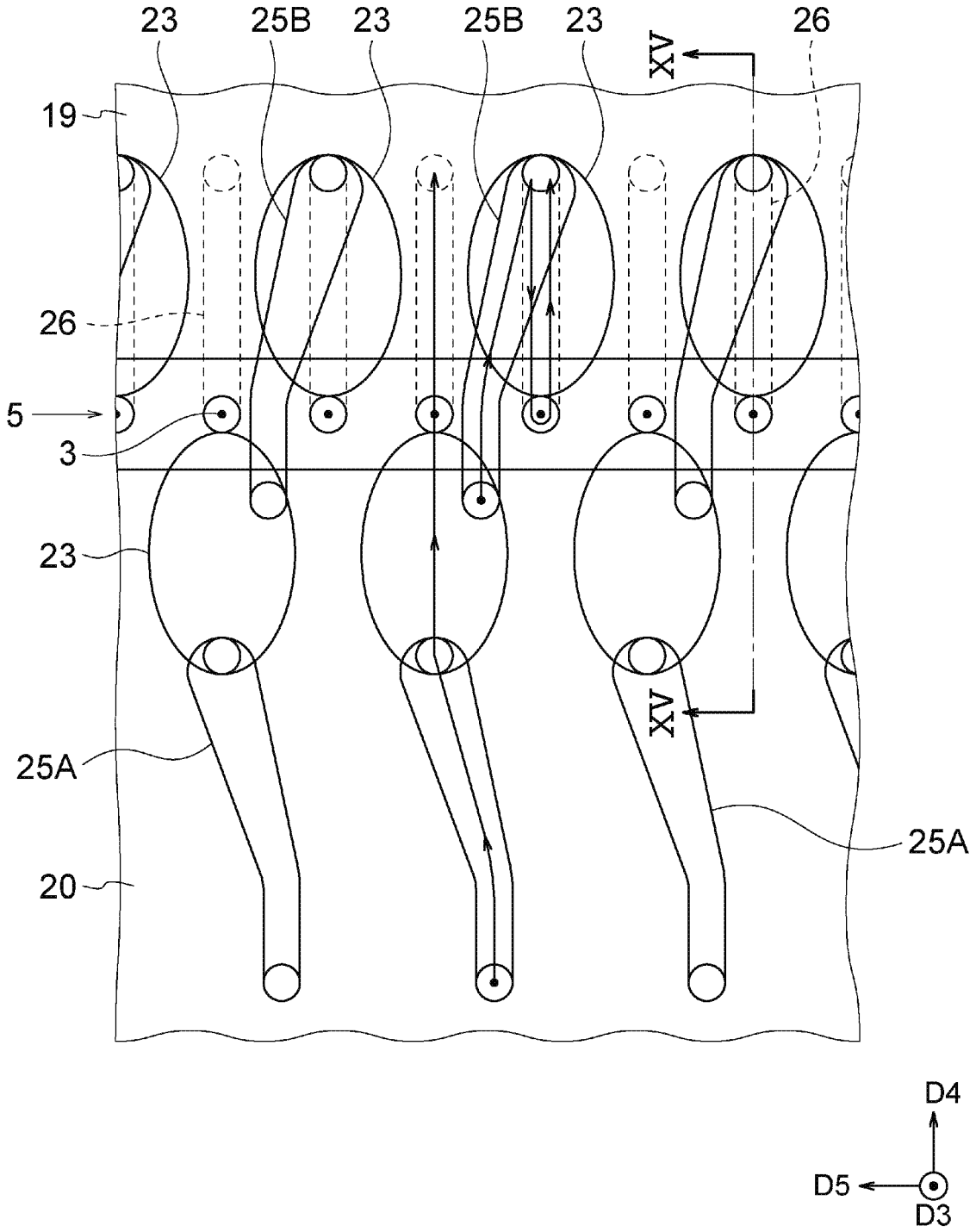
FIG. 14 is a plan view illustrating a region XIV of FIG. 13 in an enlarged manner.

For example, the pressure chamber 23 is formed to have a certain thickness in the D3 direction and is substantially rhombic, elliptic, or the like in plan view (see FIG. 14). An end portion of the pressure chamber 23 in a planar direction communicates with the partial channel 21, and an end portion on the opposite side communicates with the communication channel 25. Part of the communication channel 25 is designed as a regulation portion having a sectional area smaller than sectional areas of the common channel 19 and the pressure chamber 23 in a direction perpendicular to the flow direction.

The partial channel 21 extends from a bottom surface (surface on the negative D3 side) of the pressure chamber 23 toward the ejection surface 2*a*. The shape of the section (section perpendicular to the D3 axis) of the partial channel 21 may be set as appropriate and is, for example, circular or rectangular, although not illustrated. The sectional shape (including dimensions) of the partial channel 21 may be the same or vary over the length of the partial channel 21 (substantially in the D3 direction), and slightly varies in the illustrated example. The partial channel 21 may extend parallel to the D3 axis or extend while being tilted with respect to the D3 axis as appropriate.

The shape of the nozzle 3 may be set as appropriate. For example, the nozzle 3 is circular in plan view and the diameter thereof decreases toward the ejection surface 2*a*. In other words, the nozzle 3 has a substantially truncated cone shape. The nozzle 3 may be configured such that the diameter of a front end portion (negative D3 side portion) increases toward the front end. The opening area of the nozzle 3 in the bottom surface 21*a* is obviously smaller than the bottom surface 21*a*.

The common channel 19 extends, for example, along the ejection surface 2*a*, below the pressure chamber 23. Although not particularly illustrated, for example, the common channel 19 is configured to branch in a manifold shape and branching portions extend along, for example, the nozzle rows 5. In configurations such as the configuration in which the nozzle columns 6 are formed, the aforementioned branching portions may extend along the nozzle columns 6 instead of the nozzle rows 5.

The channel member 13 is formed by, for example, stacking multiple substrates 27A to 27J (A to J are sometimes omitted hereinafter) one on top of another. Through holes that form the multiple individual channels 17 and the common channel 19 are formed in the substrates 27. The thicknesses and the number of the multiple substrates 27 may be set as appropriate depending on matters such as the shapes of the multiple individual channels 17 and the common channel 19. The multiple substrates 27 may be made of an appropriate material and is made of, for example, metal, resin, ceramic, or silicon.

The substrate 27 located furthermost to the negative D3 side among the multiple substrates 27 is sometimes referred to as nozzle plate 27A. For example, a lower surface of the nozzle plate 27A forms the ejection surface 2*a* while an upper surface thereof forms the bottom surface 21*a* of the partial channel 21. A hole penetrating the nozzle plate 27A in the thickness direction forms the nozzle 3.

[Configuration of Actuator]

The actuator 15 is formed of, for example, a unimorph piezoelectric element that is displaced in a bend mode. Specifically, the actuator 15 includes, for example, a vibration plate 29, a common electrode 31, a piezoelectric body 33, and multiple individual electrodes 35 that are stacked in this order from the pressure chamber 23 side.

For example, the vibration plate 29, the common electrode 31, and the piezoelectric body 33 are shared by the multiple pressure chambers 23 (multiple ejection elements 11) and cover the multiple pressure chambers 23. Meanwhile, the individual electrodes 35 are disposed for the respective pressure chambers (ejection elements 11). A portion of the actuator 15 corresponding to each ejection element 11 is sometimes referred to as pressure application element 37. The configurations (except for the directions in plan view) of the respective pressure application elements 37 are the same.

For example, the vibration plate 29 is laid on the upper surface of the channel member 13 to close an opening in an upper surface of each pressure chamber 23. The pressure chamber 23 may be configured such that the substrate 27 closes the opening in the upper surface of the pressure chamber 23 and the vibration plate 29 is laid on this substrate 27. Also in this configuration, we may regard that the substrate 27 is part of the vibration plate and the vibration plate closes the pressure chamber 23.

A polarization direction of the piezoelectric body 33 is assumed to be the thickness direction (D3 direction). Accordingly, the piezoelectric body 33 contracts in a plane (plane perpendicular to the D3 axis), for example, when voltage is applied to the common electrode 31 and individual electrodes 35 and the electric field is made to act on the piezoelectric body 33 in the polarization direction. This contraction causes the vibration plate 29 to bend in a convex shape toward the pressure chamber 23 and the capacity of the pressure chamber 23 thereby changes.

The common electrode 31 extends over the multiple pressure chambers 23 as described above and a certain electric potential (for example, reference potential) is applied to the common electrode 31. Each individual electrode 35 includes an individual electrode main body 35*a* located above the pressure chamber 23 and a lead electrode 35*b* led out from the individual electrode main body 35*a*. Although not particularly illustrated, the shape and size of the individual electrode main body 35*a* are substantially the same as those of the pressure chamber 23 in plan view. Ejections of ink droplets from the multiple nozzles 3 are individually controlled by individually applying potentials (driving signals) to the multiple individual electrodes 35.

The vibration plate 29, the common electrode 31, the piezoelectric body 33, and the individual electrodes 35 may each be made of an appropriate material. For example, the vibration plate 29 is made of ceramic, silicon oxide, or silicon nitride. The common electrode 31 and the individual electrodes 35 are made of, for example, platinum or palladium. The piezoelectric body 33 is made of, for example, ceramic such as PZT (lead zirconate titanate).

Although not particularly illustrated, the actuator 15 is connected to, for example, a flexible printed circuit board (FPC) arranged above the actuator 15 and facing the same. Specifically, the FPC is connected to the lead electrodes 35*b* and is connected to the common electrode 31 through a not-illustrated via conductor and the like. For example, the controller 88 applies a certain potential to the common electrode 31 and individually inputs driving signals to the multiple individual electrodes 35 through a not-illustrated driving IC mounted on the FPC.

[Details of Nozzle Arrangement]

Figure 5A:
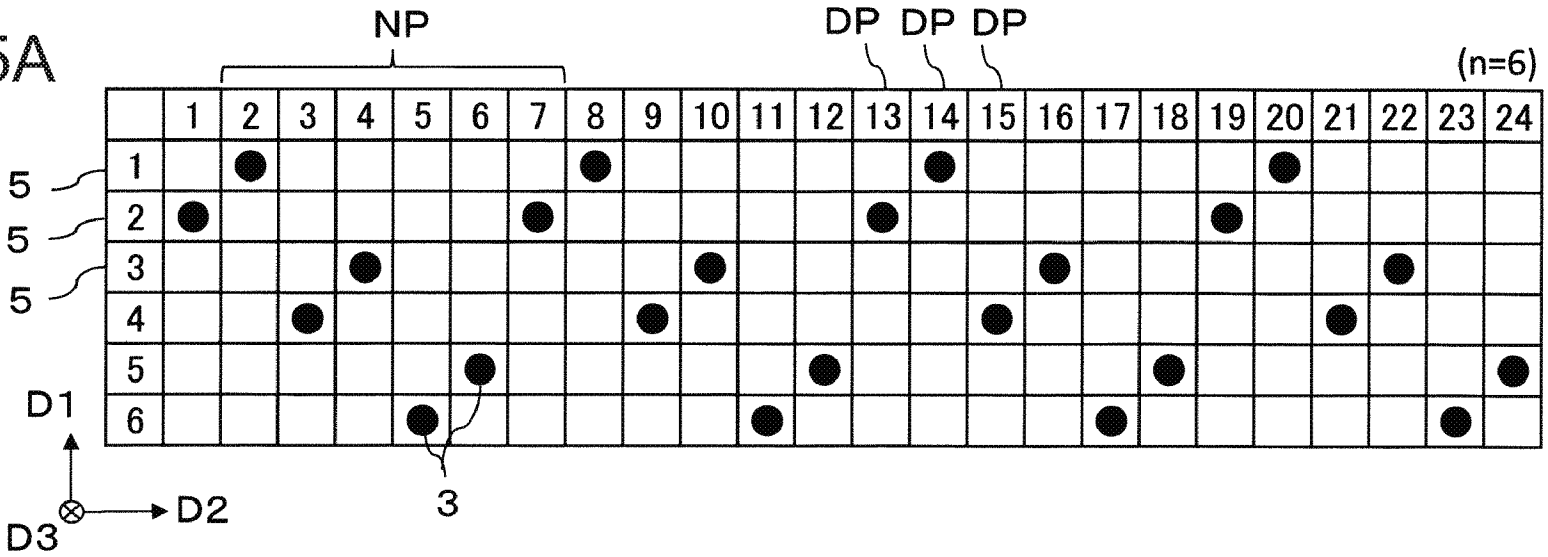
FIG. 5A is a schematic diagram illustrating a nozzle arrangement according to a comparative example and FIG. 5B is a schematic diagram illustrating a nozzle arrangement according to a first example.

FIG. 5A is a schematic diagram illustrating a nozzle arrangement according to a comparative example. FIGS. 5B to 12B are schematic diagrams illustrating various examples of nozzle arrangements according to the embodiment. These diagrams schematically illustrate the nozzle arrangements when the ejection surface 2*a* is viewed.

Specifically, the multiple rows in the tables of FIGS. 5A to 12B represent the multiple nozzle rows 5, as can be seen from the reference signs illustrated in FIG. 5A. The multiple columns correspond to the multiple dot positions DP illustrated on the line L1 in FIG. 3. The black circles in the tables represent the nozzles 3. As described above, the interval defined by the number of the dot positions DP from the dot position DP where one nozzle 3 is arranged to the dot position DP just before the dot position DP where the next nozzle 3 is arranged in each nozzle row 5 is the nozzle pitch NP. In FIG. 5A, reference sign NP is attached to part of the first nozzle row 5 as an example. Although reference signs are heavily attached to FIG. 5A, the other diagrams (FIGS. 5B to 12B can be viewed in a way similar to FIG. 5A.

In FIGS. 5A to 12B, only some of the dot positions DP are illustrated due to sheet space. However, the number of the dot positions DP can be actually set to those illustrated in the drawings. Moreover, the number of the dot positions DP can be set to that in a unit section US to be described later.

(Nozzle Arrangement in Comparative Example)

In the comparative example illustrated in FIG. 5A, the number n of the nozzle rows 5 is assumed to be six. The number of the dot positions DP in the nozzle pitch NP is the same among the multiple nozzle pitches NP and is specifically six (the same as the number n of rows). Moreover, the positions of the nozzles (nozzle pitch NP) in the respective nozzle rows 5 are shifted from one another. The n nozzle rows 5 each including m nozzles 3 can thereby perform printing for m×n dot positions arranged in the D2 direction as described with reference to FIG. 3.

No nozzle columns 6 are formed in the comparative example of FIG. 5A, unlike the comparative example of FIG. 3. As described in the explanation of FIG. 3, the positions of the n nozzle rows 5 in the D1 can be interchanged. Accordingly, the nozzle columns 6 may be formed by, for example, interchanging the first and second nozzle rows 5, interchanging the third and fourth nozzle rows 5, and interchanging the fifth and sixth nozzle rows 5 in FIG. 5A. In other words, the comparative example of FIG. 3 and the comparative example of FIG. 5A are essentially no different from each other in comparison with the embodiment.

Nozzle Arrangement of Embodiment

In the various nozzle arrangements according to the embodiment illustrated in FIGS. 5B to 12B, the nozzle pitch NP is not constant at least in one nozzle row 5 (in all nozzle rows in the illustrated examples). Specifically, at least one nozzle row 5 includes two types of nozzle pitches NP varying in the number of the dot positions DP. In the following description, the embodiment is first described by using a first example (FIG. 5B) as an example, then matters common to multiple examples are described, and thereafter a second example and beyond are described.

(Nozzle Arrangement in First Example)

Figure 5B:
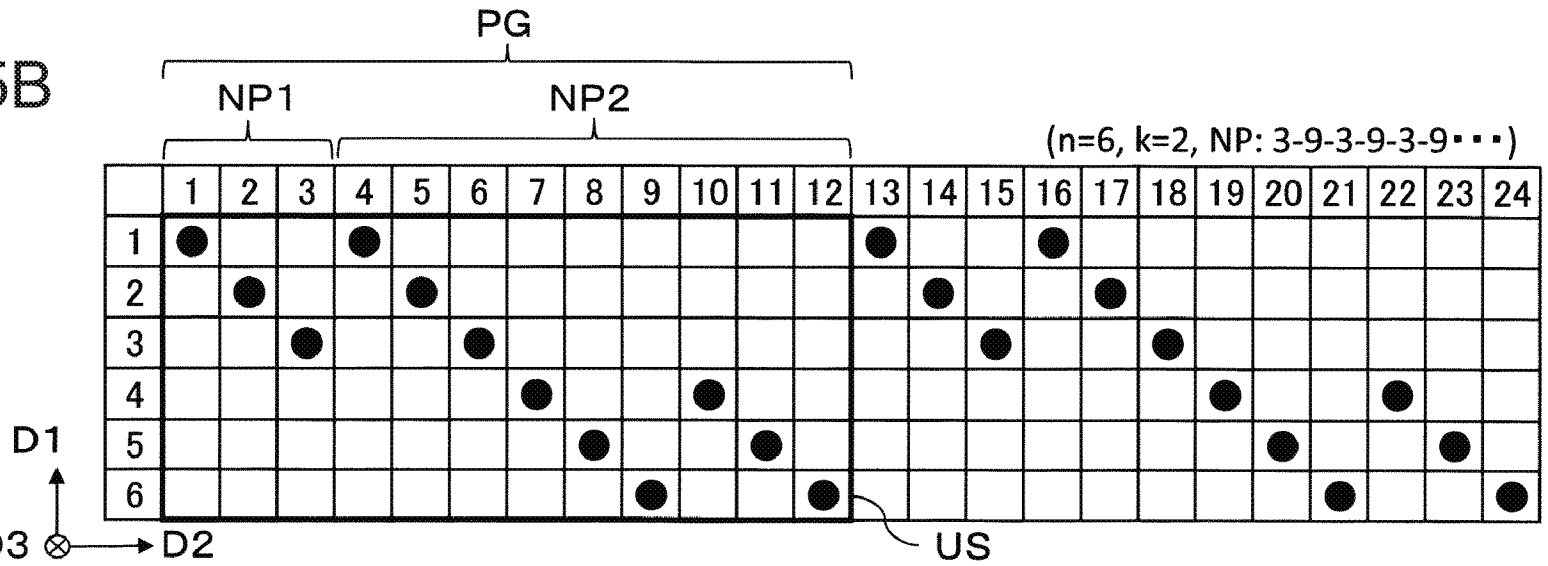

In the first example illustrated in FIG. 5B, the number n of the nozzle rows 5 is assumed to be six. In each nozzle row 5, there are two types of nozzle pitches NP (reference signs are attached to only a portion of the first row) that are 3 and 9 (referred to as nozzle pitches NP1 and NP2).

In each nozzle row 5, multiple (for example, a relatively large number of) nozzle pitches NP that are of two or more types are repeatedly arranged in a predetermined order. In the first example, two types of nozzle pitches NP that are the nozzle pitches NP1 and NP2 are alternately arranged.

(Pitch Group)

From another viewpoint, assuming that a combination of one nozzle pitch NP1 and one nozzle pitch NP2 is a pitch group PG (reference signs are attached to only a portion of the first row), multiple pitch groups PG are repeatedly arranged. In other words, assuming that a group in which k (two in the first example) nozzle pitches NP that are of two or more types (two types in the first example) are arranged in a predetermined order (order of NP1, NP2 in the illustrated example) is a pitch group PG, multiple pitch groups PG are arranged (repeated) in each nozzle row 5.

The configuration of pitch group PG is defined by the types of nozzle pitches NP, the number of the nozzle pitches NP of each type, and the arrangement order of the nozzle pitches NP. When the pitch group PG is formed of two nozzle pitches NP that are of two types as in the first example, there is essentially no difference whether the pitch group PG is defined in the order of NP1, NP2 or in the reverse order.

The configurations of the pitch groups PG in the multiple nozzle rows 5 are assumed to be the same. Specifically, the types of nozzle pitches NP (two types of nozzle pitches NP1 and NP2 in the first example), the number of nozzle pitches NP of each type (one for each type in the first example), and the arrangement order of nozzle pitches NP (order of NP1, NP2 in the illustrated example) are the same among the pitch groups PG in different nozzle rows 5.

The positions of the pitch groups PG in the multiple nozzle rows 5 in the second direction vary from one another. When the pitch group PG is regarded as a cycle, the phases of the nozzle rows 5 are shifted from one another. Due to the phase shift, between the nozzles 3 of each nozzle row 5, the nozzles 3 of the other nozzle rows 5 are located as viewed in the first direction. Instead of using the concept of the pitch group PG, the nozzle rows 5 different from one another may be regarded as nozzle rows that have the same types of nozzle pitches NP and the same arrangement order of nozzle pitches NP but are shifted from one another in the D2 direction.

(Unit Section)

The n nozzle rows 5 may be regarded to be formed by repeating a unit section US (illustrated by a bold line in FIG. 5B) in the D2 direction, the unit section US having the same length as the pitch group PG in the D2 direction and extending over the n nozzle rows. Multiple unit sections US have the same configuration. Specifically, in comparison of the multiple unit sections US, the types of nozzle pitches NP, the number of nozzle pitches NP of each type, and the arrangement order of nozzle pitches NP in the nozzle rows 5 are the same among the unit sections US.

When we focus on one unit section US, the nozzle pitch NP from the nozzle 3 located furthermost to the positive D2 side (terminal edge side) in the unit section US may be defined by the number of the dot positions DP from this nozzle 3 to the dot position DP just before the nozzle 3 located furthermost to the negative D2 side (starting edge side), assuming that the nozzle pitch NP returns from the terminal edge to the starting edge of the unit section US. Under such a definition, the aforementioned relationships in which the configurations of the pitch groups PG in the n nozzle rows 5 are the same and the phases of the pitch groups PG are shifted from one another are established also in one unit section US.

Accordingly, it is only necessary that the number m of the nozzles 3 in each nozzle row 5 is equal to or greater than the number k of nozzles 3 in each nozzle row 5 (pitch group PG) in one unit section US to establish the relationships relating to the pitch groups PG among the nozzle rows 5. Meanwhile, it is only necessary for k to be 2 or greater to say that the pitch group PG includes nozzle pitches NP varying in the number of the dot positions DP. Ultimately, it is only necessary for m to be 2 or greater. However, m is generally a relatively large number (is, for example, 700 or more and 1000 or less as described above) and there is no need to consider such a minimum value of m. It is apparent that n only needs to be 2 or greater.

(Use of Divisor of Number of Rows)

In the first example, the number (3 or 9) of dot positions DP in each of the two types of nozzle pitches NP (NP1 and NP2) is a natural multiple of one (3) of divisors of the number n (6) of nozzle rows 5 in each pitch group PG (or unit section US). The divisors herein are positive integers excluding 1 and n. Moreover, "one of divisors" herein means one commonly selected for the two or more types of nozzle pitches NP.

Assume that n=NP1×j, NP1>1, and j>1 when the number k of the nozzle pitches NP in each pitch group PG is 2 as in the first embodiment. In this situation, NP2=n×k−NP1=(j×k−1)×NP1. Specifically, NP2 is a natural multiple of a divisor (NP1) selected commonly for NP2 and NP1. Accordingly, when the number k of the nozzle pitches NP is 2, the aforementioned relationship in which each of the nozzle pitches NP (NP1 and NP2) is a natural multiple of one of divisors of the number n of rows is established as long as the number (3) of the dot positions DP in the smaller one of the two nozzle pitches NP is a divisor of the number n of rows that is 2 or greater.

When there are multiple divisors of the number n of rows, one divisor commonly selected for the two or more types of nozzle pitches NP may be selected as appropriate. For example, the greatest divisor may be selected within a limit in which two or more types of nozzle pitches NP can be achieved in n×k dot positions. This can maximize the smallest nozzle pitch NP among the two or more types of nozzle pitches NP each defined to be a natural multiple of one divisor.

(Application Range of Nozzle Arrangement)

The aforementioned configuration and arrangement of the nozzle pitches NP do not have to be established for all dot positions DP in the head 2. For example, the head 2 may be configured such that the aforementioned configuration and arrangement of the nozzle pitches NP are established for m×n dot positions DP and nozzle pitches NP (nozzles 3) for which the aforementioned configuration and arrangement are not established are disposed outside the m×n dot positions DP. In other words, regions unique regarding the arrangement of the nozzles 3 may be disposed in end portions of the head 2 in the D2 direction.

In the description of the nozzle pitches NP made with reference to FIG. 3, we state that the nozzle pitch NP from the nozzle 3 located furthermost to the positive D2 side (terminal edge side) in each nozzle row 5 may be defined by the number of the dot positions DP from this nozzle 3 to the dot position DP just before the nozzle 3 located furthermost to the negative D2 side (starting edge side), assuming that the nozzle pitch NP returns from the terminal edge to the starting edge. When the unique regions are disposed outside the n×m dot positions DP, the configuration may be such that the nozzle 3 located furthermost to the negative D2 side and the nozzle 3 located furthermost to the positive D2 side are determined, excluding the unique regions, and the nozzle pitch NP from the nozzle 3 located furthermost to the positive D2 side is defined as described above.

OTHER EXAMPLES

FIGS. 6A to 12B illustrate other examples in which the nozzle pitches NP are basically set as in the first example. Specific description is as follows.

(Nozzle Arrangements in Second to Fourth Examples)

Figure 6A:
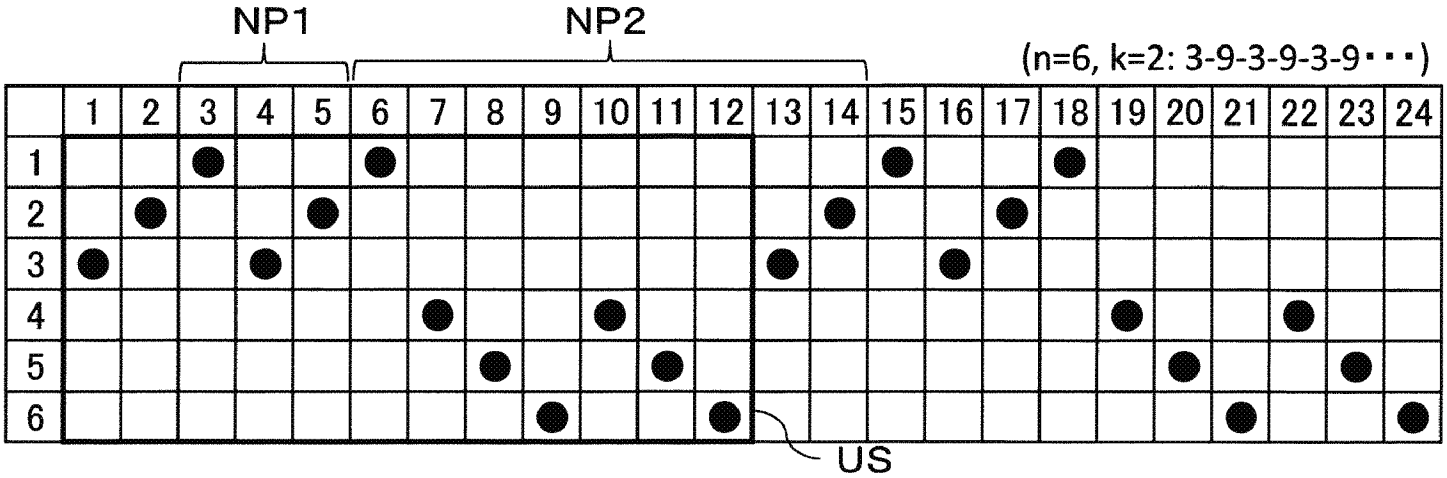
FIG. 6A is a schematic diagram illustrating a nozzle arrangement according to a second example and FIG. 6B is a schematic diagram illustrating a nozzle arrangement according to a third example.
Figure 6B:
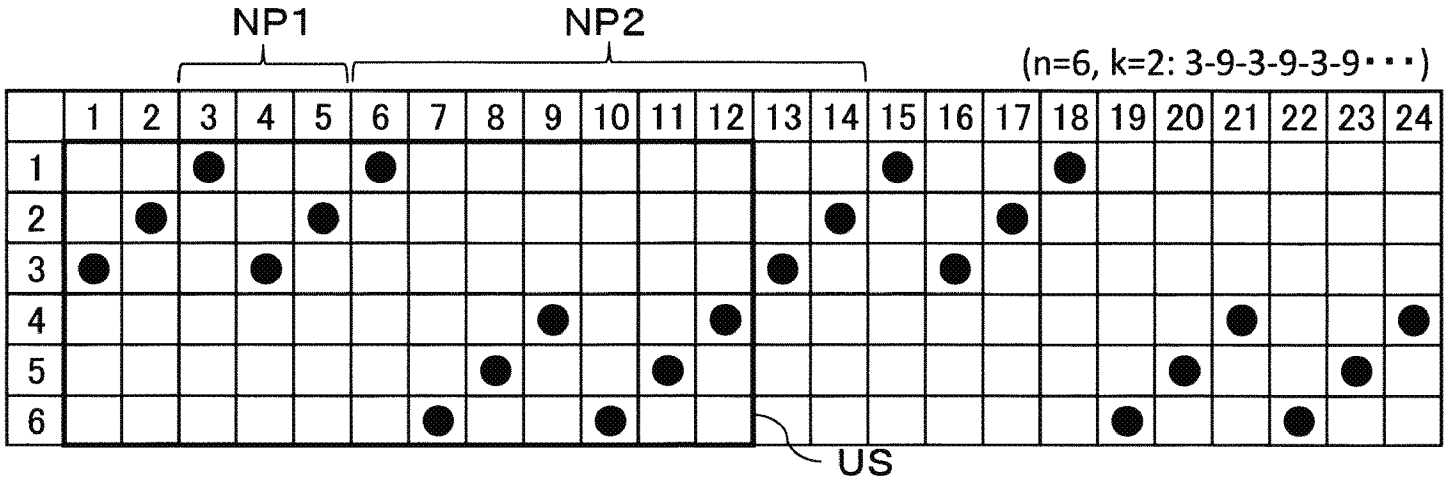
Figure 7A:
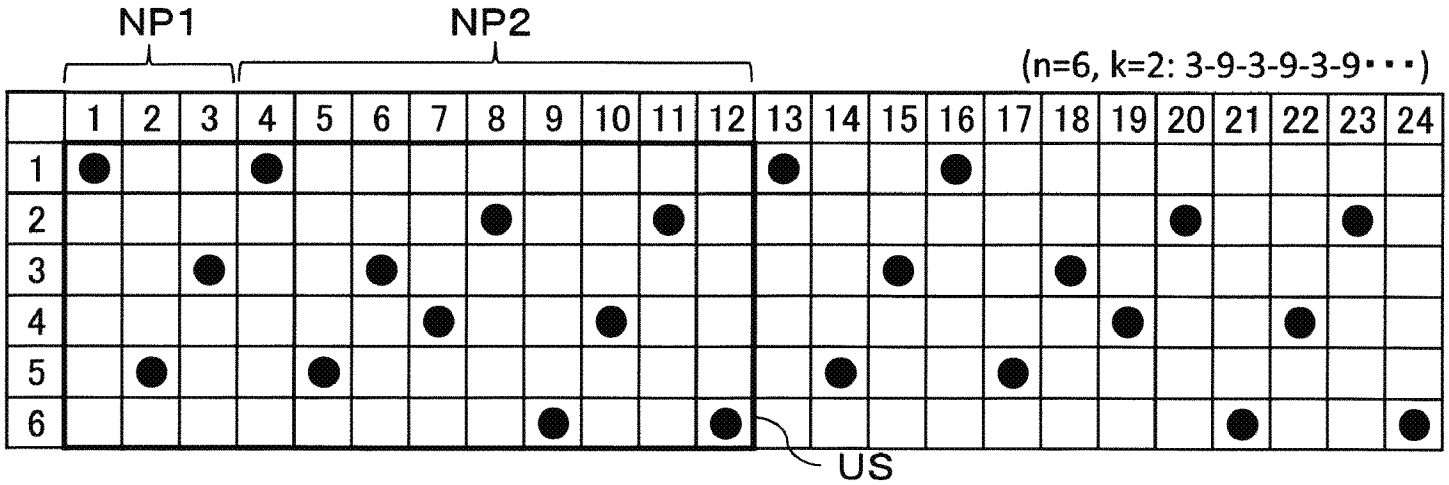
FIG. 7A is a schematic diagram illustrating a nozzle arrangement according to a fourth example and FIG. 7B is a schematic diagram illustrating a nozzle arrangement according to a fifth example.

A second example illustrated in FIG. 6A, a third example illustrated in FIG. 6B, and a fourth example illustrated in FIG. 7A are examples in which n=6, k=2, and the smaller one of the two nozzle pitches NP (reference signs are attached to only a portion of the first row) is set to 3 that is a divisor of the number n of rows (NP1=3) as in the first example illustrated in FIG. 5B.

The first to fourth examples vary in the phases assigned to the respective nozzle rows 5 (shifting of the nozzle rows 5 from one another). In the description of the comparative examples of FIGS. 3 and 5A, we state that the positions of the nozzle rows 5 in the D1 direction may be interchanged. The first to fourth examples may be considered as examples in which the positions of the nozzle rows 5 in the D1 direction are interchanged. The positions of the nozzle rows 5 in the D1 direction may be interchanged in the other examples to be described below, as in the first to fourth examples, although not particularly illustrated.

(Nozzle Arrangement in Fifth Example)

Figure 7B:
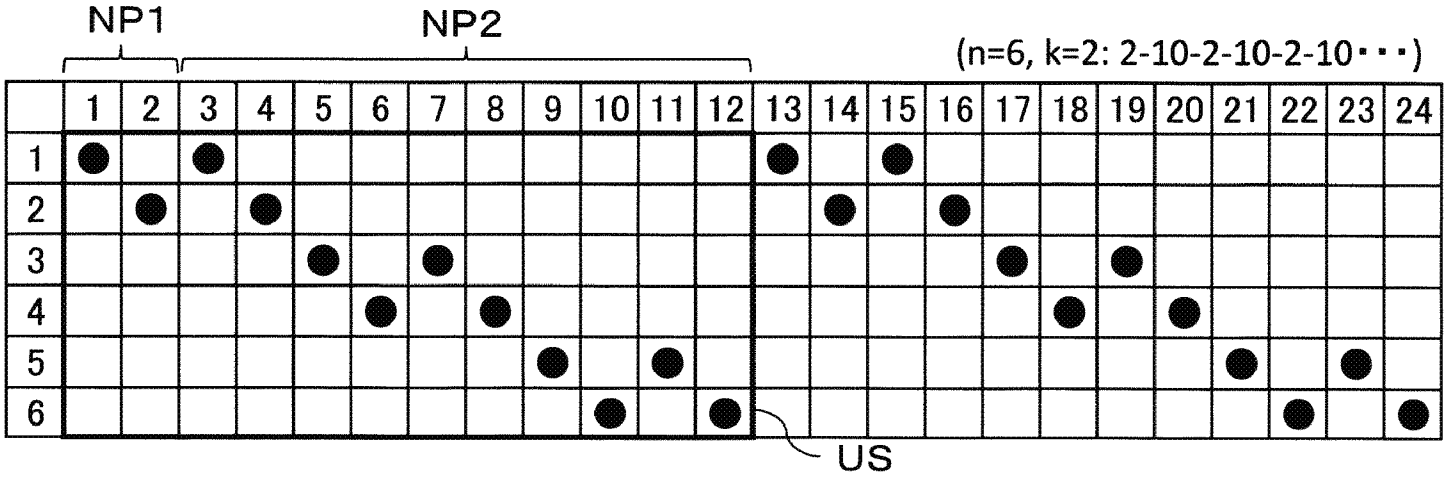

In a fifth example illustrated in FIG. 7B, n=6 and k=2 as in the first to fourth examples. However, the smaller one of the two nozzle pitches NP (reference signs are attached to only a portion of the first row) is set to 2 (NP1=2) unlike the first to fourth examples. Note that 2 is also a divisor of the number n of nozzle rows 5 like 3 set for NP1 in the first to fourth examples.

(Nozzle Arrangement in Sixth and Seventh Examples)

Figure 8A:
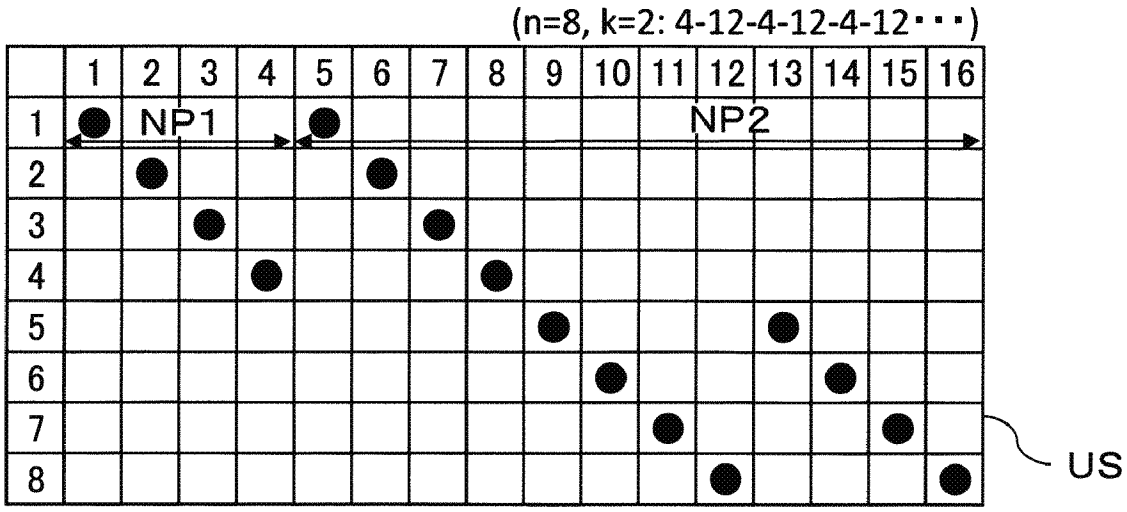
FIG. 8A is a schematic diagram illustrating a nozzle arrangement according to a sixth example and FIG. 8B is a schematic diagram illustrating a nozzle arrangement according to a seventh example.
Figure 8B:
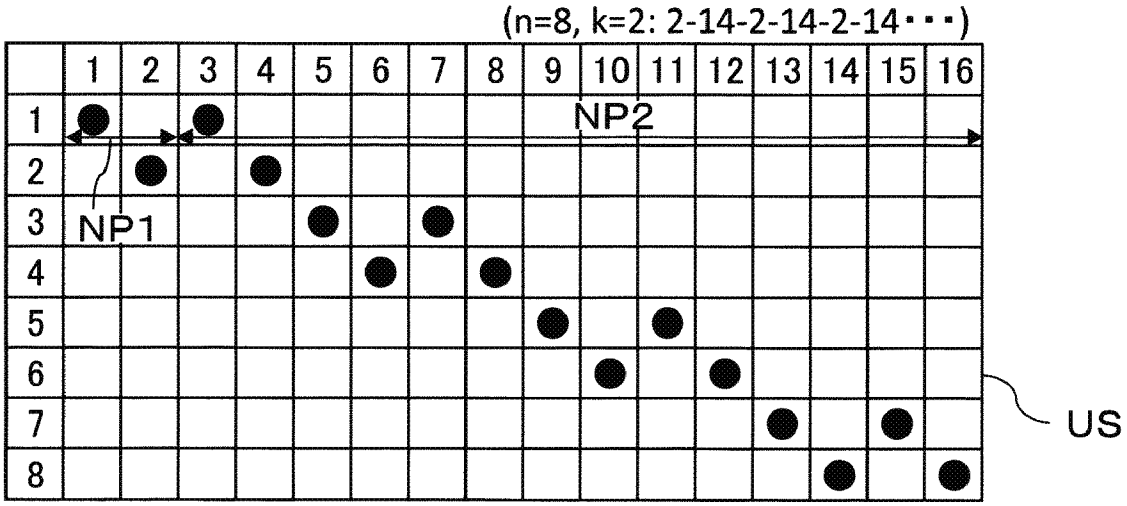

A sixth example illustrated in FIG. 8A and a seventh example illustrated in FIG. 8B are examples in which n=8 unlike in the first to fifth examples. However, k=2 as in the first to fifth examples. In FIGS. 8A and 8B, an arrangement of the nozzles 3 in a range of one unit section US is illustrated for convenience of illustration (the same applies to the following drawings).

Also in these examples, the nozzle pitches NP are set by using a divisor of the number n of rows for the n×k dot positions DP (pitch group PG or unit section US) as in the other examples described above. Specifically, in FIG. 8A, the smaller one of the two nozzle pitches NP (reference signs are attached to only the first row) is set to 4 (NP1=4) that is a divisor of the number n (8) of rows. Moreover, in FIG. 8B, the smaller one of the two nozzle pitches NP (reference signs are attached to only the first row) is set to 2 (NP1=2) that is a divisor of the number n (8) of rows.

(Nozzle Arrangements in Eighth and Ninth Examples)

Figure 9:
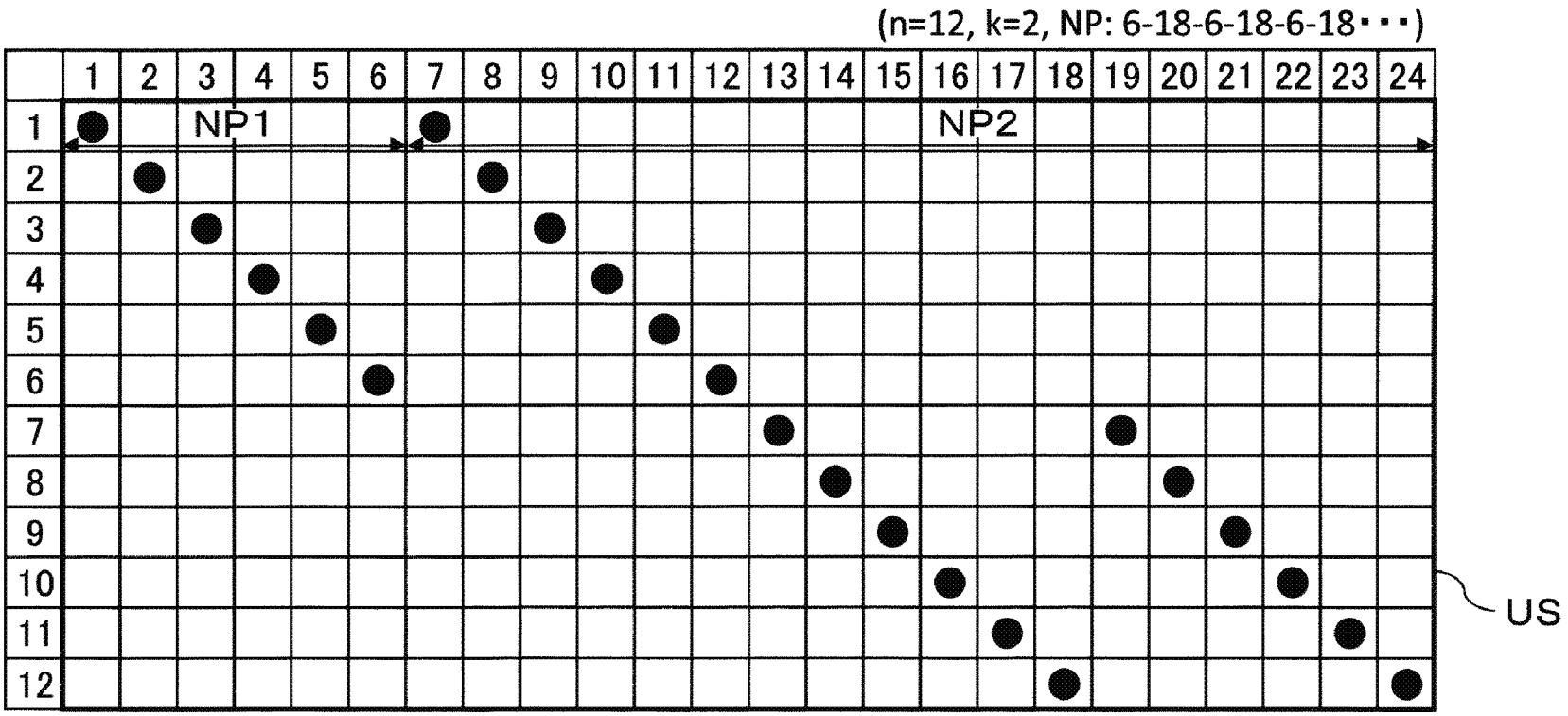
FIG. 9 is a schematic diagram illustrating a nozzle arrangement according to an eighth example.
Figure 10:
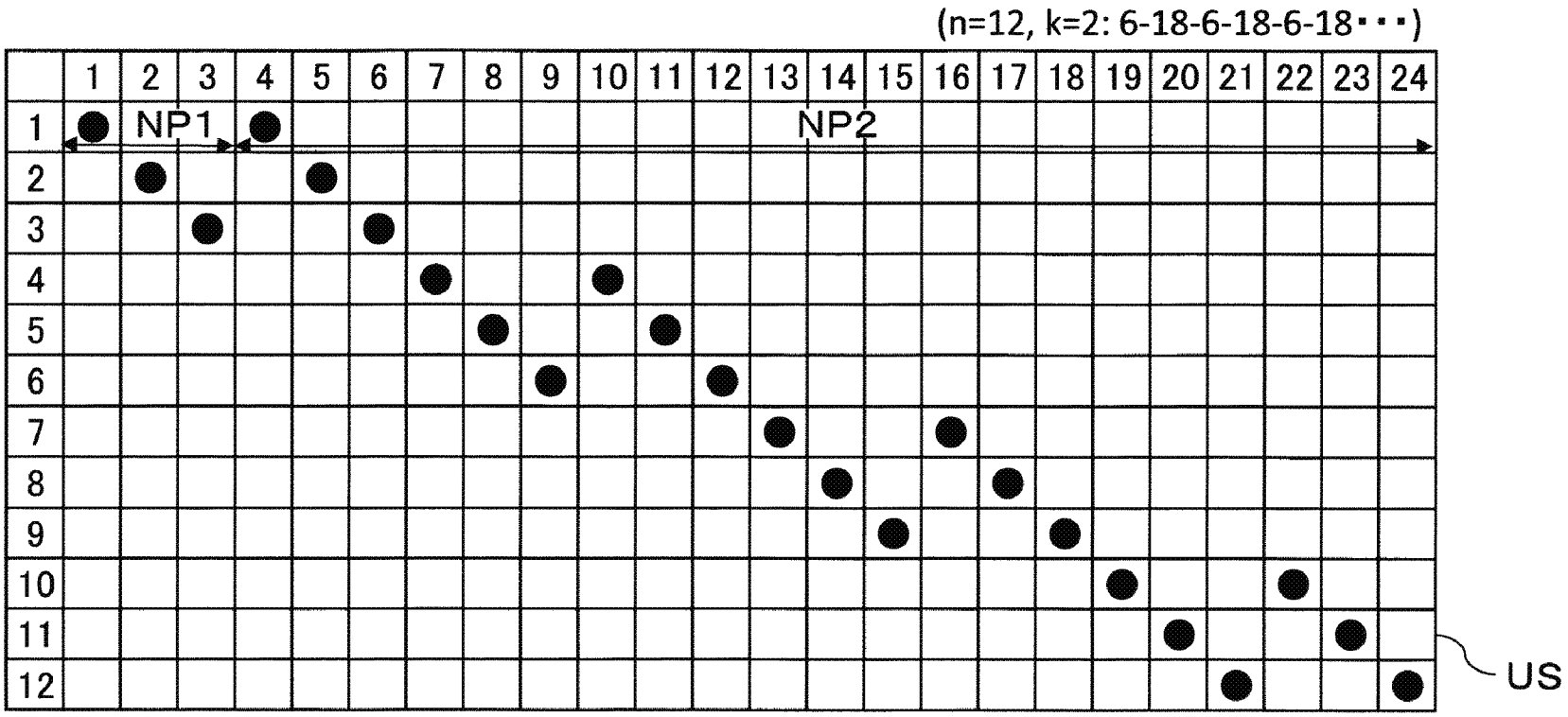
FIG. 10 is a schematic diagram illustrating a nozzle arrangement according to a ninth example.

An eighth example illustrated in FIG. 9 and a ninth example illustrated in FIG. 10 are examples in which n=12 unlike in the aforementioned examples. However, k=2 as in the aforementioned examples. Also in these examples, the nozzle pitches NP are set as in the aforementioned other examples except for the specific values of n and NP. Specifically, in FIG. 9, the smaller one of the two nozzle pitches NP (reference signs are attached to only the first row) is set to 6 (NP1=6) that is a divisor of the number n (12) of rows. Moreover, in FIG. 10, the smaller one of the two nozzle pitches NP (reference signs are attached to only the first row) is set to 3 (NP1=3) that is a divisor of the number n (12) of rows. Although not particularly illustrated, NP1 may be 4.

(Nozzle Arrangement in Tenth Example)

Figure 11:
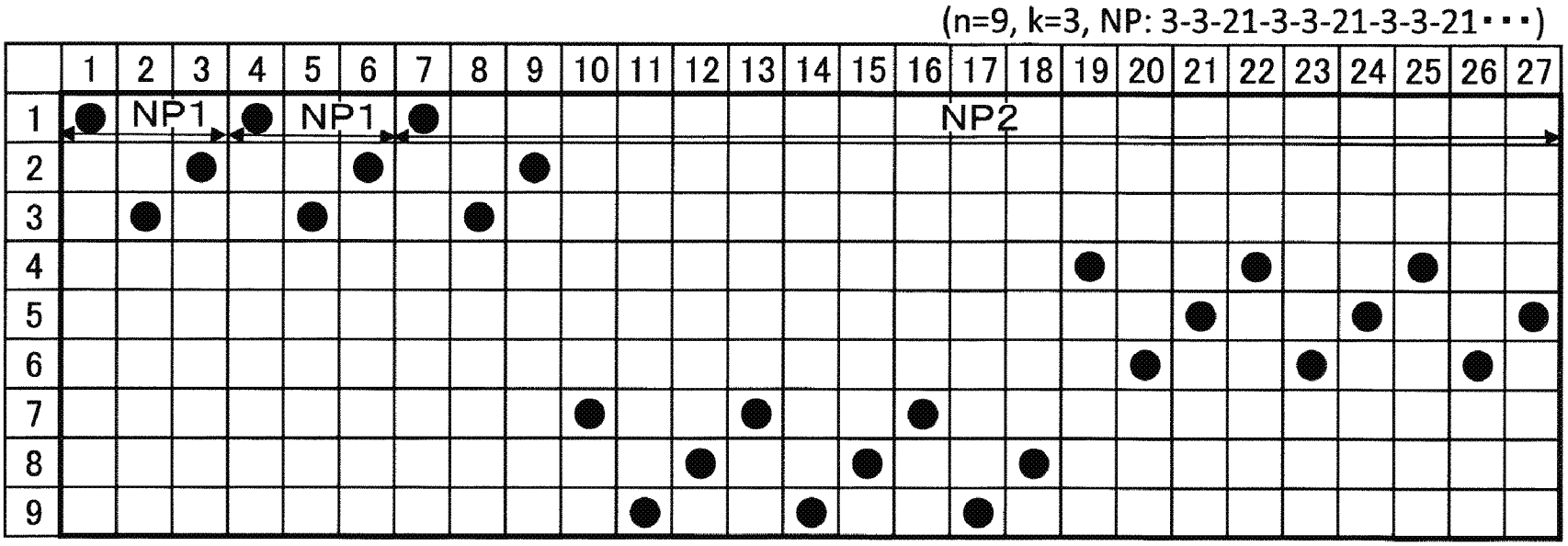
FIG. 11 is a schematic diagram illustrating a nozzle arrangement according to a tenth example.

A tenth example illustrated in FIG. 11 is an example in which n=9. Moreover, k=3 unlike in the aforementioned examples. However, the nozzle pitches NP are set as in the aforementioned other examples also in the tenth example, except for the specific values.

Specifically, in this example, all three nozzle pitches NP (reference signs are attached to only the first row) in each pitch group PG (unit section US) are set to natural multiples of a divisor (3) of the number n (9) of rows. Moreover, in this example, the number of nozzle pitches NP is greater than the number of types of the nozzle pitches NP in each pitch group PG. Specifically, there are two nozzle pitches NP1 in which the number of the dot positions DP is 3 and one nozzle pitch NP2 in which the number of the dot positions DP is 21. The nozzle pitches NP are arranged in such an order that the two nozzle pitches NP1 are arranged and then the nozzle pitch NP2 is arranged.

Although not particularly illustrated, also when k is greater than 3, a pitch group PG may be achieved in which k−1 nozzle pitches NP1 are consecutively arranged and then one nozzle pitch NP2 (NP2>NP1) is arranged as in the tenth example, the nozzle pitches NP1 being pitches in which the number of the dot positions DP is one of the divisors of the number n of rows, the nozzle pitch NP2 being a pitch in which the number of the dot positions DP is a natural multiple of the one divisor. In such a pitch group PG, the configurations (the types of nozzle pitches NP, the number of nozzle pitches NP of each type, and the arrangement order of nozzle pitches NP) of the pitch groups PG can be made the same among the n nozzle rows 5 as in the first to ninth examples.

Just to be sure, the arrangement order of the nozzle pitches NP is equivalent even if the phase is changed. For example, the arrangement order of NP1, NP1, NP2, the arrangement order of NP1, NP2, NP1, and the arrangement order of NP2, NP1, NP1 only vary in phase with respect to the reference position (for example, starting edge of the pitch group PG) and are equivalent to one another.

(Nozzle Arrangement of Eleventh Example)

In the eleventh example illustrated in FIG. 12A, n=9 and k=3 as in the tenth example. Also in the eleventh example, as in the aforementioned other embodiments, all k (three) nozzle pitches NP in each pitch group PG (unit section US) are set to natural multiples of a divisor (3) of the number n (9) of rows in each nozzle row 5.

However, in the eleventh example, the number of the dot positions DP varies among all k nozzle pitches NP in the pitch group PG (there are k types of nozzle pitches NP) in at least one of the nozzle rows 5 unlike in the tenth example. From another viewpoint, each pitch group PG includes three or more types of nozzle pitches NP in at least one nozzle row 5. From yet another viewpoint, the configurations of pitch group PG are not necessary the same among the n nozzle rows 5. In other words, the head 2 includes two or more types of nozzle rows 5 varying in the configurations of the pitch group PG. However, the number of the dot positions DP (n×k) is the same among the pitch groups PG varying in the configurations.

Specifically, in this example, the nozzle pitches NP are 6, 3, and 18 in the order of arrangement in the first to third rows. The nozzle pitches NP are 12, 3, and 12 in the fourth to sixth rows. The nozzle pitches NP are 9, 3, and 15 in the seventh to ninth rows. Note that, as described above, the arrangement order of the nozzle pitches NP is equivalent even if the phase is changed. For example, the arrangement order of 6, 3, and 18 may be considered as 3, 18, and 6 or 18, 3, and 6.

(Nozzle Arrangement of Twelfth Example)

A twelfth example illustrated in FIG. 12B is an example in which n=8 and k=2 as in FIG. 8A and FIG. 8B. However, in this example, the nozzle pitches NP are not natural multiples of one of divisors (excluding 1 and n) of the number n of nozzle rows 5, unlike in the aforementioned examples.

Specifically, in the illustrated example, the nozzle pitches NP are 5 and 11 in the first to fifth rows. Moreover, the nozzle pitches NP are 3 and 13 in the sixth to eighth rows.

In the embodiment, the head 2 includes the multiple nozzles 3 opened on the ejection surface 2*a* extending in the first direction (D1 direction) and the second direction (D2 direction) orthogonal to the D1 direction as described above, and n nozzle rows 5 each including m nozzles 3 arranged in the direction (D5 direction) intersecting the D1 direction are arranged parallel to one another, where n and m are each an integer of 2 or greater. Between the nozzles 3 of each nozzle row 5, the nozzles 3 of the other nozzle rows 5 are located as viewed in the D1 direction and the nozzles 3 are thereby located at m×n dot positions DP. The interval defined by the number of the dot positions DP from the dot position DP where one nozzle 3 is arranged to the dot position DP just before the dot position DP where the next nozzle 3 is arranged in each nozzle row 5 is referred to as nozzle pitch NP. In this configuration, at least one of the nozzle rows 5 includes two or more types of nozzle pitches NP varying in the number of the dot positions DP.

Accordingly, for example, a degree of freedom in design of the nozzles 3 and channels around the nozzles 3 is improved. This is specifically described below. When only one type of nozzle pitch NP is set as in the comparative examples illustrated in FIGS. 3 and 5A, the number of the dot positions DP in each nozzle pitch NP is the same as the number n of rows. Meanwhile, when two or more types of nozzle pitches NP varying in the number of the dot positions DP are disposed in each nozzle row 5 as in the examples, nozzle pitches NP in which the number of the dot positions DP is smaller than the number n of rows and nozzle pitches NP in which the number of the dot positions DP is greater than the number n of rows are disposed. As a result, channels to pass between the nozzles 3 (strictly speaking, partial channels 21) can be easily disposed in the nozzle pitches NP in which the number of the dot positions DP is greater than the number n of rows. From another viewpoint, this configuration facilitates securing of sufficient width of the channels between the nozzles 3. This is explained later by using a specific example.

Moreover, for example, shade unevenness can be made less visible. This is specifically described below. For example, the ink ejection characteristics of a certain nozzle row 5 are sometimes different from the ink ejection characteristics of the other nozzle rows 5 due to a machining error. For example, assume that, in FIG. 3, the ejection characteristics of the nozzle row 5C illustrated by the black circles are different from the ejection characteristics of the other nozzle rows 5. In this configuration, dots different in the amount of ink attaching to the recording medium P or the like from the other dots periodically appear as seen from the black circles on the line L1. These periodical dots form lines extending in the D1 direction. When there are such periodical lines, shade unevenness is easily visually recognized. However, when there are two or more types of nozzle pitches NP, the periodicity is reduced from that in the configuration with only one type of nozzle pitch NP. As a result, visibility of shade unevenness is reduced.

Moreover, for example, when the distance between the adjacent nozzles 3 is uneven, the configuration of the individual channels 17 adjacent to each other or the distance between these individual channels 17 can be easily made uneven. In this configuration, for example, the resonance frequency of an entire set of two adjacent individual channels 17 is different from the resonance frequency of another entire set of two adjacent individual channels 17. Accordingly, for example, a risk of unnecessary vibration of ink causing resonance over multiple individual channels 17 is reduced.

Moreover, in the embodiment, the multiple pitch groups PG each including the multiple nozzle pitches NP that are of two or more types are arranged in at least one of the nozzle rows 5. The types of nozzle pitches NP, the number of nozzle pitches NP of each type, and the arrangement order of nozzle pitches NP are the same among the multiple pitch group PG.

Accordingly, for example, the nozzle pitches NP can be easily designed. Specifically, completely irregularly setting nozzle pitches NP for many nozzles 3 is cumbersome but burden of designing can be reduced by repeating the pitch groups PG with the same configuration. Moreover, for example, some level of regularity in the arrangement of the nozzles 3 is expected to be beneficial for stable ink supply to the multiple nozzles 3.

Moreover, in the embodiment, the multiple pitch groups PG each including the multiple nozzle pitches NP that are of two or more types are arranged in each of the n nozzle rows 5. Furthermore, the types of nozzle pitches NP, the number of nozzle pitches NP of each type, and the arrangement order of nozzle pitches NP are the same among the multiple pitch group PG in each of the n nozzle rows 5. Moreover, the number of the dot positions DP in each pitch group PG is the same among the n nozzle rows 5.

From another viewpoint, the aforementioned description means that the unit sections US with the same configuration are arranged. Accordingly, appropriately setting the nozzle pitches NP for the section unit US allows the nozzle pitches NP to be set for all of the n nozzle rows 5 by repeating the unit section US. As a result, the burden of designing is further reduced.

Moreover, in the embodiment (first to tenth examples: FIGS. 5B to 11), the types of nozzle pitches forming each pitch group PG, the number of nozzle pitches of each type, and the arrangement order of the nozzle pitches may be the same among the n nozzle rows 5. Moreover, the positions of the multiple pitch groups PG in the n nozzle rows 5 may be shifted from one another in the D2 direction.

In this configuration, the same setting of the nozzle pitches NP can be used for the n nozzle rows 5 in the setting of the nozzle pitches NP for the unit section US as described above and the burden of designing is further reduced.

Moreover, in the embodiment, when k is set to an integer of 2 or greater, each pitch group PG is formed of n×k dot positions DP and includes k nozzle pitches NP in each of the n nozzle rows 5. The number of the dot positions DP in each of the k nozzle pitches may be a natural multiple of a divisor of n selected commonly for the k nozzle pitches NP from divisors of n that are 2 or greater and smaller than n.

For example, assume a situation where the same pitch groups PG are set in the nozzle rows 5 as many as the aforementioned one divisor and the nozzles 3 are distributed to the n×k dot positions DP. In this case, the number of leftover dot positions DP at which no nozzles 3 are arranged is also a natural multiple of the aforementioned one divisor and the number of settable nozzle pitches NP is also a natural multiple of the aforementioned one divisor. As a result, for example, the same pitch groups PG (not necessary the same as the aforementioned first pitch groups PG) can be set again for the nozzle rows 5 as many as the aforementioned one divisor. In other words, the same pitch groups PG can be easily used for the multiple nozzle rows 5.

Moreover, in the embodiment, k may be 2. The number of the dot positions in the nozzle pitch NP in which the number of dot positions DP is smaller among the two nozzle pitches NP in each pitch group PG may be set to a divisor of n that is 2 or greater.

In this situation, since k=2, 2n dot positions DP are split between the two nozzle pitches NP (NP1+NP2=n). Moreover, since NP1≠NP2, NP1<n and NP2>n.

Here, temporarily assume that n has not been determined yet. When the nozzle pitch NP1 is to be applied to multiple nozzle rows 5 and the nozzles 3 are to be distributed to all dot positions DP in the nozzle pitch NP1 as viewed in the first direction, the nozzle rows 5 as many as NP1 is necessary as can be seen from the first to third rows of FIG. 5B and the like. Accordingly, n needs to be a multiple of NP1 to apply the nozzle pitch NP1 to the n nozzle rows 5 where n>NP1.

On the other hand, when n is determined in advance and the same nozzle pitch NP1 is to be applied to the n nozzle rows 5, NP1 needs to a divisor of n. When NP1 is a divisor of n in the configuration in which k=2, NP2 is a natural multiple of NP1 as described above.

In view of this, assume a situation where the nozzle rows 5 are formed by repeating a pitch group PG which includes n×k dot positions DP and in which k nozzles 3 (nozzle pitch NP) are arranged and the configurations of the pitch group PG are made the same among the n nozzle rows. In this situation, when k=2 and the smaller nozzle pitch NP is set to a divisor of n, the n×k nozzles 3 can be consistently distributed to the n×k dot positions DP (no overlapping of the dot positions DP at which the nozzles 3 are arranged occurs between different nozzle rows 5). Moreover, when k=2, two types of nozzle pitches NP are alternately arranged. Thus, for example, the individual channels can be easily made to pass every one portion between the nozzles 3.

Example of Channels Passing Between Nozzles

As described above, in the embodiment, the nozzle pitches NP each including a greater number of the dot positions DP than the number n of rows are set and the channels that pass between the adjacent nozzles 3 (partial channel 21) can be thereby easily formed. An example of this configuration is described below.

Figure 13:
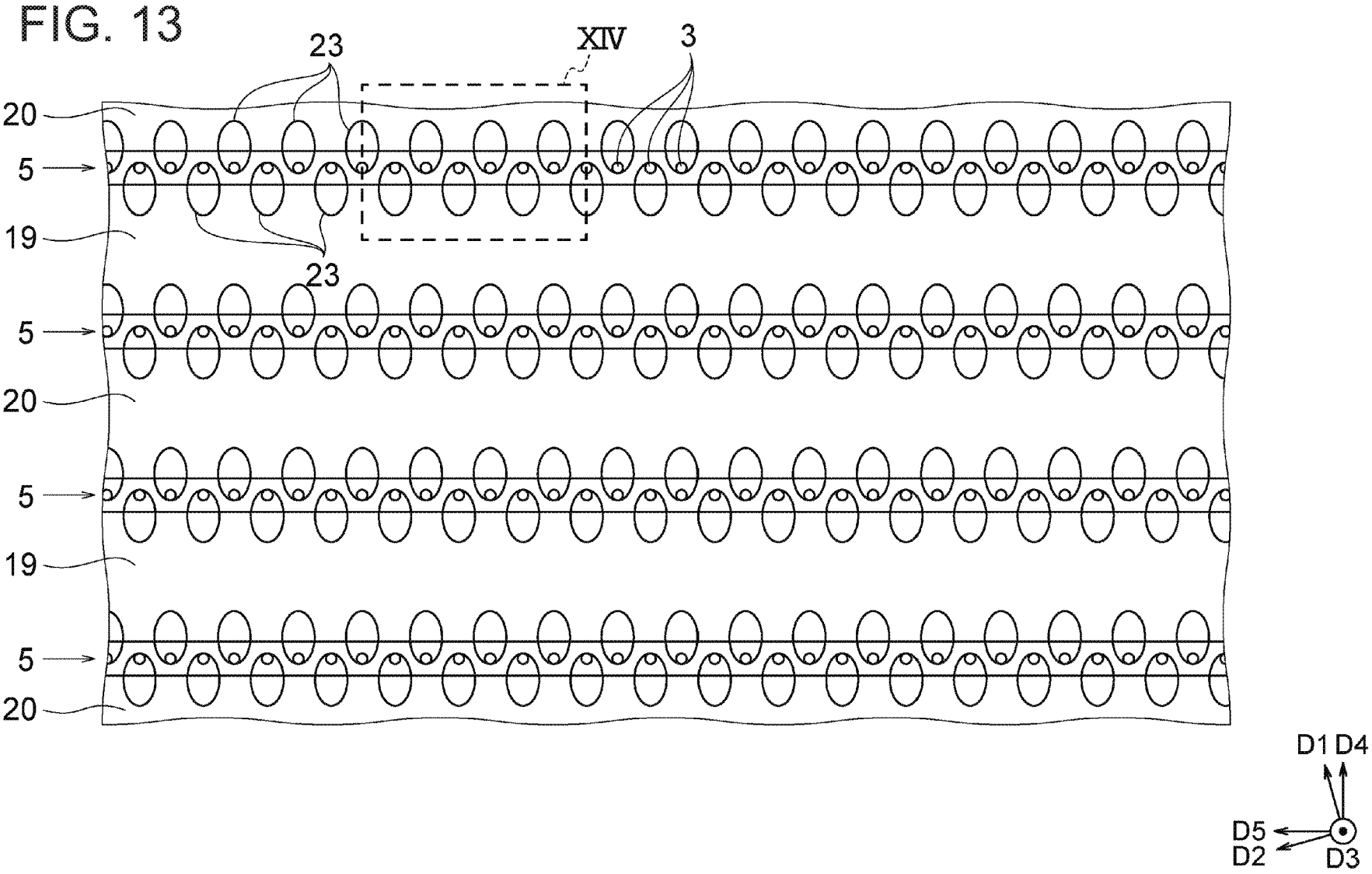
FIG. 13 is a plan view of part of the head.

FIG. 13 is a plan view of part of the head 2. Although the head 2 illustrated in FIG. 13 has a structure different from the structure of the head 2 illustrated in FIG. 4, configurations with basically the same functions as the configurations in FIG. 4 are denoted by the same reference signs for the convenience of description.

In the head 2, multiple supply common channels 19 and multiple collection common channels 20 extend parallel to one another. Each of the supply common channels 19 is a common channel for supplying the ink to the multiple individual channels 17 (see FIG. 4, only the pressure chambers 23 and the nozzles 3 are illustrated in FIG. 13). Each of the collection common channels 20 is a common channel for collecting the ink from the multiple individual channels 17. Although not particularly illustrated, the multiple supply common channels 19 may be branches of a channel that branches in a manifold shape. Similarly, the multiple collection common channels 20 may be branches of a channel that branches in a manifold shape. The supply common channels 19 and the collection common channels 20 are adjacent to one another (are alternately arranged). These common channels are parallel to, for example, the D5 axis.

The nozzle row 5 is present between each pair of the supply common channel 19 and the collection common channel 20 adjacent to each other to extend along these channels. Moreover, the multiple pressure chambers 23 individually connected to the multiple nozzles 3 in each nozzle row 5 are alternately arranged on the supply common channel 19 side and the collection common channel 20 side of the nozzle row 5 and are arranged along the nozzle row 5. For example, the pressure chambers 23 arranged on the supply common channel 19 side at least partially overlap the supply common channel 19. Similarly, for example, the pressure chambers 23 arranged on the collection common channel 20 side at least partially overlap the collection common channel 20.

Figure 15:
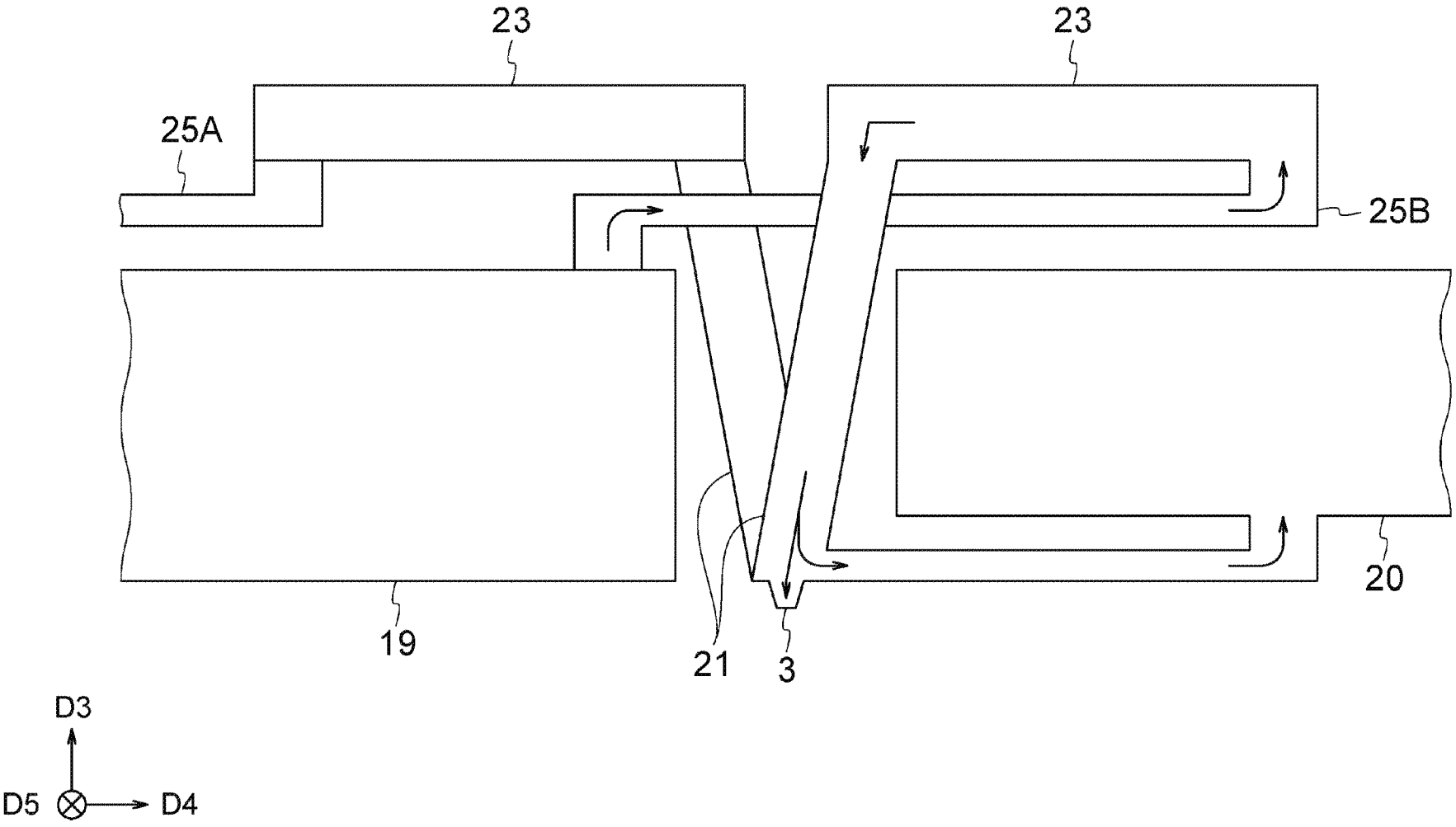
FIG. 15 is a schematic sectional view corresponding to a XV-XV line in FIG. 14.

FIG. 14 is a plan view illustrating the region XIV of FIG. 13 in an enlarged manner. FIG. 15 is a schematic sectional view corresponding to the XV-XV line in FIG. 14. Note that, in FIG. 14, some of the channels (collection communication channels 26 to be described later) are illustrated in dotted lines to improve the visibility of the drawing. Moreover, in FIGS. 14 and 15, arrows illustrate flow of the ink from the supply common channel 19 to the collection common channel 20.

The supply common channel 19 is connected to the multiple pressure chambers 23 via multiple supply communication channels (25A and 25B). Moreover, the collection common channel 20 is connected to the multiple partial channels 21 via multiple collection communication channels 26. Accordingly, the ink in the supply common channel 19 is supplied to the nozzles 3 via the supply communication channels 25, the pressure chambers 23, and the partial channels 21 as described with reference to FIG. 4. Meanwhile, an excessive portion of the supplied ink is collected from the partial channels 21 into the collection common channel 20 via the collection communication channels 26.

The supply communication channels 25 are located, for example, above the supply common channel 19 and the collection common channel 20. Meanwhile, the collection communication channels 26 are located, for example, below the collection common channel 20. However, the arrangement may be changed as appropriate to an arrangement in which the collection communication channels 26 are located above the collection common channel 20 or to similar arrangements. Each collection communication channel 26 may be connected to an appropriate portion of the corresponding partial channel 21. In the illustrated example, the collection communication channel 26 is connected to a lower end portion of a side surface of the partial channel 21.

The supply communication channels 25A connected to the pressure chambers 23 arranged on the supply common channel 19 side of the nozzles 3 and the supply communication channels 25B connected to the pressure chambers 23 arranged on the collection common channel 20 side of the nozzles 3 vary in positions relative to the nozzles 3 and the like.

Specifically, each supply communication channel 25A is connected to the supply common channel 19, on the opposite side of the pressure chamber 23 to the nozzle 3, extends toward the nozzle 3 from this connection position, and is connected to the pressure chamber 23. Meanwhile, each supply communication channel 25B extends from the supply common channel 19 toward the collection common channel 20 while passing between the partial channels 21 and is connected to the pressure chamber 23.

Since the pressure chambers 23 for one nozzle row 5 are arranged alternately on the supply common channel 19 side and the collection common channel 20 side of the nozzle row 5, the supply communication channels 25B are not arranged in all portions between the multiple partial channels 21 but in every one portion between the multiple partial channels 21. Moreover, for example, when two types of nozzle pitches NP1 and NP2 (NP1<NP2) varying in the number of the dot positions DP are disposed, the portions between the partial channels 21 that correspond to the nozzle pitches NP2 are larger than those in the configuration (comparative example) in which the nozzle pitch NP is constant. Accordingly, the supply communication channels 25B are arranged in the gaps corresponding to the aforementioned nozzle pitches NP2. This facilitates securing of sufficient width of the supply communication channels 25B.

The direction D1 in the aforementioned embodiment is an example of the first direction. The D2 direction is an example of the second direction. The D5 direction is an example of the direction intersecting the first direction. The supply communication channel 25B is an example of the passage channel. The supply common channel 19 is an example of the common channel and the supply communication channel 25B is an example of the communication channel.

The technique according to the present disclosure is not limited to the aforementioned embodiment and may be carried out in various modes.

For example, the head is not limited to a piezoelectric head that applies pressure to individual channels by using piezoelectric elements. For example, the head may be a thermal head that generates air bubbles in liquid by using heating elements and applies pressure to individual channels.

Although the effect of facilitating securing of the sufficient width of the channels passing between the partial channels, the effect of reducing the visibility of the shading unevenness, and the like are given as the effects of the technique according to the present disclosure, these effects do not have to be necessarily achieved.

The arrangements of the nozzles 3 illustrated in FIGS. 5B to 12B are merely examples. For example, when the unit section US including n×k dot positions DP is to be repeatedly set for the head 2, there are various methods of setting the nozzle pitches NP for the unit section US. Specifically, there are arrangements as many as the number obtained by dividing a product of ${}_{n\times k}C_{2}\cdot{}_{n\times k-1}C_{2}\cdot{}_{n\times k-2}C_{2}\cdots{}_{n\times k-n+1}C_{2}$ by the number (n×k) of equivalent combinations from the viewpoint of phase shift and subtracting the number (${}_{n}P_{n}$) of comparative examples (nozzle pitch NP is constant) from the quotient (the fact that the nozzle rows 5 are interchangeable is ignored herein).

For example, there may be one nozzle row 5 different in the configurations of the pitch group PG from all other nozzle rows 5. Moreover, for example, multiple pitch groups PG that are of two or more types may be arranged in one nozzle row 5 in a predetermined order or in random. When the pitch groups PG that are of two or more types are arranged in a predetermined order, an entire set of these pitch groups PG can be considered as one pitch group PG. Moreover, for example, no regularity such as repeating of the pitch group PG may be found in one nozzle row 5 or n nozzle rows 5 (the nozzles 3 may be randomly arranged).

In the examples, each nozzle row 5 includes at least one dot position DP in which no nozzle 3 is arranged, between the nozzles 3 adjacent to each other. Such a configuration is intended to make the pitch of the dot positions DP smaller than the pitch of the nozzles 3 as can be understood from the description of FIG. 3. However, each nozzle row 5 may include adjacent nozzles 3 arranged at adjacent dot positions DP (may include a portion where the nozzle pitch NP is 1). In this case, 1 may be selected as the divisor of the number n of nozzle rows 5 unlike in the examples.

The pitch of the dot positions as viewed in the first direction (pitch of the n×m dot positions DP on the line L1)

does not have to be constant. In such a configuration, the effect of reducing the shade unevenness is further improved.

REFERENCE SIGNS LIST

1 PRINTER (RECORDING APPARATUS)
2 LIQUID EJECTION HEAD
2A EJECTION SURFACE
3 NOZZLE
5 NOZZLE ROW
DP DOT POSITION
NP NOZZLE PITCH

The invention claimed is:

1. A liquid ejection head comprising:

a plurality of nozzles opened on an ejection surface extending in a first direction and a second direction orthogonal to the first direction, wherein a number n of nozzle rows, each nozzle row of the number n of nozzle rows comprising a number m of nozzles of the plurality of nozzles arranged in a direction intersecting the first direction, the number n of nozzle rows disposed in parallel, where n and m are each an integer of 2 or greater, as viewed in the first direction, the plurality of nozzles are located at a number m×n of dot positions, wherein other nozzles of other nozzle rows of the number n of nozzle rows are positioned between the nozzles of the each nozzle row, at least one nozzle row of the nozzle rows comprises two or more types of nozzle pitches varying in a number of dot positions, where each nozzle pitch of the two or more types of nozzle pitches is an interval defined by the number of dot positions from a first dot position where one of the nozzles of the at least one nozzle row is arranged to a second dot position that is just before a dot position where a next one of the nozzles of the at least one nozzle row is arranged, and the number m×n of dot positions are at constant pitches, and every nozzle row comprises two or more types of the nozzle pitches.

2. The liquid ejection head according to claim 1, wherein in the at least one of the number n of nozzle rows, a plurality of pitch groups, each comprising a nozzle pitches of two or more types, is arranged, and types of the nozzle pitches, a number of the nozzle pitches of each of the types, and an arrangement order of the nozzle pitches are identical among the plurality of pitch groups.

3. The liquid ejection head according to claim 2, wherein in each of the number n of nozzle rows, the plurality of pitch groups, each comprising the nozzle pitches of two or more types, is arranged, and the types of the nozzle pitches, the number of the nozzle pitches of each of the types, and the arrangement order of the nozzle pitches are identical among the plurality of pitch groups, and the number of dot positions in each of the pitch groups is identical among the number n of the nozzle rows.

4. The liquid ejection head according to claim 3, wherein the types of nozzle pitches, the number of the nozzle pitches of each of the types, and an arrangement order of the nozzle pitches forming the pitch groups are identical among the number n of the nozzle rows, and positions of the plurality of pitch groups in the number n of the nozzle rows are shifted from one another in the second direction.

5. A liquid ejection head comprising a plurality of nozzles opened on an ejection surface extending in a first direction and a second direction orthogonal to the first direction, wherein a number n of nozzle rows, each nozzle row of the number n of nozzle rows comprising a number m of nozzles of the plurality of nozzles arranged in a direction intersecting the first direction, the number n of nozzle rows disposed in parallel, where n and m are each an integer of 2 or greater, as viewed in the first direction, the plurality of nozzles are located at a number m×n of dot positions, wherein other nozzles of other nozzle rows of the number n of nozzle rows are positioned between the nozzles of the each nozzle row, at least one nozzle row of the nozzle rows comprises two or more types of nozzle pitches varying in a number of dot positions, where each nozzle pitch of the two or more types of nozzle pitches is an interval defined by the number of dot positions from a first dot position where one of the nozzles of the at least one nozzle row is arranged to a second dot position that is just before a dot position where a next one of the nozzles of the at least one nozzle row is arranged, in each of the number n of nozzle rows, a plurality of pitch groups, each comprising a nozzle pitches of two or more types, is arranged, types of the nozzle pitches, a number of the nozzle pitches of each of the types, and an arrangement order of the nozzle pitches are identical among the plurality of pitch groups, and the number of dot positions in each of the pitch groups is identical among the number n of the nozzle rows, each of the plurality of pitch groups comprises n×k of the dot positions and comprises k of the nozzle pitches, where k is an integer of 2 or greater, and the number of dot positions in each of k of the nozzle pitches is a natural multiple of a divisor of n selected commonly for k of the nozzle pitches from divisors of n that is 2 or greater and less than n.

6. The liquid ejection head according to claim 5, wherein k is 2, and the number of dot positions in a nozzle pitch with a smaller number of dot positions between two of the nozzle pitches in each of the plurality of pitch groups is a divisor of n that is 2 or greater.

7. A liquid ejection head comprising:

a plurality of nozzles opened on an ejection surface extending in a first direction and a second direction orthogonal to the first direction;

a plurality of partial channels which are located inside the ejection surface, and in which the plurality of nozzles are opened on the ejection surface; and a passage channel passing a gap of a plurality of gaps between the plurality of partial channels, the gap corresponding to a nozzle pitch with a greater number of dot positions than other nozzle pitches of two or more types of nozzle pitches, wherein a number n of nozzle rows, each nozzle row of the number n of nozzle rows comprising a number m of nozzles of the plurality of nozzles arranged in a direction intersecting the first direction, the number n of nozzle rows disposed in parallel, where n and m are each an integer of 2 or greater, as viewed in the first direction, the plurality of nozzles are located at a number m×n of dot positions, wherein other nozzles of other nozzle rows of the number n of nozzle rows are positioned between the nozzles of the each nozzle row, and at least one nozzle row of the nozzle rows comprises the two or more types of nozzle pitches varying in a number of dot positions, where each nozzle pitch of the two or more types of nozzle pitches is an interval defined by the number of dot positions from a first dot position where one of the nozzles of the at least one nozzle row is arranged to a second dot position that is just before a dot position where a next one of the nozzles of the at least one nozzle row is arranged.

8. The liquid ejection head according to claim 6, further comprising:

a plurality of partial channels which are located inside the ejection surface, and in which the plurality of nozzles are opened on the ejection surface;

a plurality of pressure chambers individually communicating with the plurality of partial channels;

a plurality of communication channels individually communicating with the plurality of pressure chambers; and a common channel commonly communicating with the plurality of communication channels, wherein in the at least one nozzle row of the nozzle rows, the common channel is located on one side of the at least one nozzle row in the first direction, the plurality of pressure chambers are alternately arranged on a common channel side of the at least one nozzle row and a side of the at least one nozzle row opposite to the common channel side, along the at least one nozzle row, and the plurality of communication channels connected to the plurality of pressure chambers located on the side opposite to the common channel side extend from the common channel to the plurality of pressure chambers, and pass gaps of a plurality of gaps between the plurality of partial channels, the gaps corresponding to one, with a greater number of the dot positions, of the two of the nozzle pitches in each of the plurality of pitch groups.

9. A recording apparatus comprising:

the liquid ejection head according to claim 1; and a moving unit that moves at least one of the liquid ejection head and a recording medium relative to each other in the first direction.

10. A recording apparatus comprising:

the liquid ejection head according to claim 1;

a head chamber housing the liquid ejection head; and a controller, wherein the controller controls at least one of temperature, humidity, and air pressure in the head chamber.

11. A recording apparatus comprising:

the liquid ejection head according to claim 1; and an application unit that applies a coating agent to a recording medium.

12. A recording apparatus comprising:

the liquid ejection head according to claim 1; and a dryer that dries a recording medium.

13. The liquid ejection head according to claim 1, wherein the number n of nozzle rows comprising the number of m nozzles are opened in one nozzle plate.

14. The liquid ejection head according to claim 7, wherein in the at least one of the number n of nozzle rows, a plurality of pitch groups, each comprising a nozzle pitches of two or more types, is arranged, and types of the nozzle pitches, a number of the nozzle pitches of each of the types, and an arrangement order of the nozzle pitches are identical among the plurality of pitch groups.

15. The liquid ejection head according to claim 14, wherein in each of the number n of nozzle rows, the plurality of pitch groups, each comprising the nozzle pitches of two or more types, is arranged, and the types of the nozzle pitches, the number of the nozzle pitches of each of the types, and the arrangement order of the nozzle pitches are identical among the plurality of pitch groups, and the number of dot positions in each of the pitch groups is identical among the number n of the nozzle rows.

16. The liquid ejection head according to claim 15, wherein the types of nozzle pitches, the number of the nozzle pitches of each of the types, and an arrangement order of the nozzle pitches forming the pitch groups are identical among the number n of the nozzle rows, and positions of the plurality of pitch groups in the number n of the nozzle rows are shifted from one another in the second direction.

17. The liquid ejection head according to claim 15, wherein each of the plurality of pitch groups comprises n×k of the dot positions and comprises k of the nozzle pitches, where k is an integer of 2 or greater, and the number of dot positions in each of k of the nozzle pitches is a natural multiple of a divisor of n selected commonly for k of the nozzle pitches from divisors of n that is 2 or greater and less than n.

18. The liquid ejection head according to claim 5, further comprising a plurality of partial channels which are located inside the ejection surface, and in which the plurality of nozzles are opened on the ejection surface; and a passage channel passing a gap of a plurality of gaps between the plurality of partial channels, the gap corresponding to a nozzle pitch with a greater number of dot positions than other nozzle pitches of two or more types of nozzle pitches.

19. The liquid ejection head according to claim 5, wherein the number n of nozzle rows comprising the number of m nozzles are opened in one nozzle plate.

20. The liquid ejection head according to claim 7, wherein the number n of nozzle rows comprising the number of m nozzles are opened in one nozzle plate.

* * * * *